US007900757B2

(12) United States Patent
Sisitsky

(10) Patent No.: US 7,900,757 B2
(45) Date of Patent: Mar. 8, 2011

(54) CARRYING BAG HAVING A DETACHABLE BOTTOM PORTION

(76) Inventor: Aviva Warter Sisitsky, Rye, NY (US)

( * ) Notice: Subject to any disclaimer, the term of this patent is extended or adjusted under 35 U.S.C. 154(b) by 384 days.

(21) Appl. No.: 12/128,016

(22) Filed: May 28, 2008

(65) Prior Publication Data

US 2009/0294237 A1 Dec. 3, 2009

(51) Int. Cl.
*A45C 3/00* (2006.01)
*A45C 13/02* (2006.01)

(52) U.S. Cl. ..... 190/100; 190/109; 190/110; 150/113; 150/116; 383/38

(58) Field of Classification Search ..... 190/108, 190/103, 109, 110, 124; 150/113, 114, 116; 383/38
See application file for complete search history.

(56) References Cited

U.S. PATENT DOCUMENTS

| | | | | | |
|---|---|---|---|---|---|
| 767,898 | A | | 8/1904 | Lamphier | |
| 1,206,276 | A | | 11/1916 | Wallach | |
| 1,996,653 | A | | 4/1935 | Rodgers | |
| 2,009,077 | A | * | 7/1935 | Walitzky | 150/112 |
| 2,118,323 | A | | 5/1938 | Murphy | |
| 2,463,993 | A | | 3/1949 | Meyers | |
| 2,555,778 | A | | 6/1951 | Blume | |
| 2,570,851 | A | | 10/1951 | Peyser | |
| 2,672,903 | A | | 3/1954 | Machinist | |
| 2,801,666 | A | | 8/1957 | Steele | |
| 2,858,957 | A | * | 11/1958 | Darrah | 220/23.4 |
| 3,186,529 | A | | 6/1965 | Gilbert | |
| 3,335,775 | A | | 8/1967 | Adams | |
| 3,696,850 | A | * | 10/1972 | Rosenblum | 190/108 |
| 3,726,329 | A | | 4/1973 | Dean | |
| 3,955,609 | A | | 5/1976 | Siegel | |
| 4,022,261 | A | | 5/1977 | Russell | |
| 4,112,991 | A | | 9/1978 | Barbaresi | |
| 4,192,365 | A | | 3/1980 | Siegel | |
| 4,673,070 | A | * | 6/1987 | Ambal | 190/108 |
| 4,693,345 | A | * | 9/1987 | Mittelmann | 190/108 |
| 4,781,277 | A | * | 11/1988 | Lim | 190/1 |
| 4,836,343 | A | * | 6/1989 | Arney | 190/108 |
| 4,883,207 | A | | 11/1989 | McArthur | |

(Continued)

FOREIGN PATENT DOCUMENTS

FR 1 562 995 4/1969

OTHER PUBLICATIONS

International Search Report for International Application No. PCT/US2009/003234, mailed Feb. 4, 2010.

(Continued)

*Primary Examiner* — Sue A Weaver
(74) *Attorney, Agent, or Firm* — Jones Day; Anthony D. Mustillo

(57) ABSTRACT

A carrying bag that includes a top portion having at least two side walls, a closable top, a closed bottom having an exterior bottom surface and an interior top compartment. The carrying bag also includes a detachable bottom portion having at least two side walls, a closed top having an exterior top surface, a closed bottom an interior bottom compartment and at least one access opening into the interior bottom compartment, and a compartmentalized structure having a plurality of individual compartments. A track system is included to attach the top portion to the detachable bottom portion, where the track system has a first component and a second component that slidingly engage one another.

22 Claims, 19 Drawing Sheets

U.S. PATENT DOCUMENTS

| | | | | |
|---|---|---|---|---|
| 5,005,679 | A | 4/1991 | Hjelle | |
| 5,038,842 | A * | 8/1991 | Huang | 150/113 |
| D328,522 | S | 8/1992 | Buck | |
| 5,209,279 | A | 5/1993 | Wilson | |
| 5,219,423 | A | 6/1993 | Kamaya | |
| 5,350,045 | A * | 9/1994 | Robertson | 190/110 |
| 5,628,443 | A * | 5/1997 | Deutsch | 224/583 |
| 5,687,819 | A | 11/1997 | Lodge et al. | |
| 5,749,447 | A | 5/1998 | Hersch et al. | |
| 5,815,843 | A * | 10/1998 | Brillhart et al. | 2/247 |
| 5,829,502 | A | 11/1998 | Distefano et al. | |
| 6,237,660 | B1 * | 5/2001 | Giardino | 150/105 |
| 6,283,183 | B1 | 9/2001 | Cooper | |
| 6,394,157 | B2 | 5/2002 | Luna | |
| 6,491,074 | B1 | 12/2002 | Roegner | |
| 6,561,240 | B2 | 5/2003 | Ma | |
| 6,637,485 | B1 | 10/2003 | Sartena | |
| 6,823,909 | B1 * | 11/2004 | Marsteller | 150/113 |
| 6,994,132 | B2 | 2/2006 | Antrobus | |
| D526,120 | S | 8/2006 | Lee et al. | |
| 2003/0000612 | A1 | 1/2003 | Sutton | |
| 2003/0094389 | A1 | 5/2003 | Thompson et al. | |
| 2006/0126969 | A1 | 6/2006 | Paller | |

OTHER PUBLICATIONS

Written Opinion of the International Searching Authority for International Application No. PCT/US2009/003234, mailed Feb. 4, 2010.

* cited by examiner

CARRYING BAG HAVING A DETACHABLE BOTTOM PORTION

BACKGROUND OF THE INVENTION

1. Field of the Invention

Embodiments of the present invention relate generally to carrying bags. More particularly, embodiments of the present invention relate to multi-portion carrying bags having at least a top portion and a detachable bottom portion.

2. Description of the Related Art

Many types of carrying or tote bags are known in the art. Carrying bags are traditionally used to carry and keep within arm's reach a wide range of items that may be needed or used numerous times during the course of a day. Typical items commonly carried in a carrying bag may include items for children and adults such as: diapers, toys, food and snacks, clothing, shoes, books, portable electronics such as a DVD player, DVDs and other baby or child-related items, and cosmetics, beauty aids, automobile and house keys, travel or airline tickets, pens and notepads, cellular telephones, checkbooks, personal data assistants (PDAs), wallets, money, credit cards, sporting equipment and other useful adult items. One problem frequently associated with carrying so many items of diverse sizes and shapes is that it becomes difficult to quickly or easily find a particular desired item within the single storage enclosure that is typical of most carrying bags. This is because the items are usually layered on top of one another in a bucket-like area in the middle or interior of the bag resulting in the desired item being hidden underneath others.

Further, because there is typically no way to organize the items in the bucket-like area of the bag, the items constantly shift and commingle with one another during use of the bag. This is typical of existing pocketbooks, knap sacks, back packs, tote bags, etc. To help a user organize items within existing carrying bags, smaller bags are typically used to store snacks and food, insulated bags may be used to store drinks, "diaper pods" may be used to hold baby changing items and accessory cases may be used for cosmetics, etc. When all of these smaller bags are placed and carried within the bucket-like portion of the main bag together with other larger necessary items, it becomes difficult to find desired items because the smaller bags as well as the loose items not contained in the smaller bags, inevitably become commingled with and layered on top of each other, making it just as difficult to find a desired item quickly or easily.

Take, for example, a diaper bag. A problem with existing diaper bags is that they typically do not separate large bulkier items that are necessary for travel with a child, from smaller items, such as pacifiers, bags of snacks, spoons, straws, bottles, sippy cups, canisters of powdered formula, a child's socks and shoes, and the caregiver or user's PDAs, cell phones, keys, wallets, checkbooks, passports, etc. Although existing bags include side pockets on the interior or exterior walls, these pockets do not solve this problem because of the number of items necessary to carry at once and because the pockets are usually too small, too narrow, too full or are open at the top such that items within those pockets fall out into the bucket-like portion of the bag when in use or when the bag is turned over, dropped, knocked down, etc.

Traveling with an infant or small child, even if only to the local store, requires having an overwhelming amount of items, which may include many, if not all, of the items previously discussed, on hand and readily available. Accordingly, existing carrying or diaper bags become bulky and cumbersome. If, for example, the child's diaper needs to be changed, the bulky and cumbersome diaper bag is usually brought with the child and caregiver to the changing area that is typically found in a public restroom. These changing areas are typically narrow, busy and often dirty and hence, managing a heavy over stuffed carrying or diaper bag together with an infant or child, becomes cumbersome and problematic. An alternative for users of typical diaper or carrying bags has been to leave the entire carrying or diaper bag behind but not before pulling out of it a "diaper pod" or accessory bag that contains only the necessities for a diaper change such as, diapers, wipes, creams and a changing pad, or if a "diaper pod" or accessory bag was not used, separately finding and pulling out all of the changing items and juggling these separate items with the child while traveling to and from the changing area.

Another situation where current diaper or carrying bags are deficient is when traveling with an infant or small child on an airplane. Typically, a diaper or carrying bag is carried onto an airplane with the caregiver or user. Because of the necessity of having everything accessible to a user that may possibly be needed during the flight, regardless of its duration, including items such as books, games and portable electronic devices such as DVD players to occupy the child; pacifiers, stuffed animals, books and blankets to pacify the child; or food, bottles, diapers, etc., to care for the child, these bags often become large and cumbersome making it difficult to stow these bags under an airplane seat. Accordingly, the entire tote or diaper bag must typically be stowed in an overhead compartment. This is problematic because of the numerous times a user must go into a diaper bag to retrieve necessary items to either feed, change or otherwise occupy the child (toys, books, DVDs, etc.). The alternative has been to carry two or more smaller bags onto the airplane and constantly shift items between the two, which is burdensome both because of the need to carry multiple bags with the child together with checked luggage, and because the items become commingled between the two bags making it difficult for a user to keep track of which items are where.

Examples of existing carrying or tote bags include U.S. Pat. No. 2,672,903 to Machinist (the "'903 patent") and U.S. Pat. No. 5,209,279 to Wilson (the "'279 patent"). The '903 patent is directed to a duplex handbag having two units—a first unit and a second unit. The first unit comprises an entire handbag that may be used independently of the second unit. The second unit comprises an auxiliary handbag detachably secured to the first unit. The second unit attaches to the bottom of the first unit in a hanging or dependent fashion and is closed at the bottom and sides but open at the top. Because the second unit is open at its top end, the bottom wall of the first unit to which the second unit is attached, serves as the closure for the top of the second unit. There is no means provided for closing the top end of the second unit when it is detached from the first unit.

Disadvantageously, because the second unit's access is only through its open top, in order for a person to access the second unit's interior, the second unit must be detached from the first unit. Further, because the second unit is opened at its top end while attached to the first unit, detaching the second unit can result in items contained therein, falling out or becoming displaced. Additional disadvantages with the second unit having an open top while attached and detached from the first unit is: (1) the second unit cannot function as a stand-alone unit that can be detached and stowed away with items contained therein; and (2) the mechanisms to attach the first and second units to one another cannot be located on the bottom and top surfaces of the top and bottom units, respectively. Having the attachment mechanisms located interiorly between the two units (i.e. on the bottom and top surfaces), is advantageous because, in this configuration, the mechanisms will be substantially concealed and there is less of an opportunity for the units to become inadvertently detached from one another.

Another disadvantage with the bag of the '903 patent is the length of time it may take to attach and detach the first and second units. The first and second units attach to one another by way of a plurality of individual fastening elements. Therefore, to detach the units from one another each fastening element must be undone separately, which is time consuming. Further, to attach the first and second units together, each portion of the fastening elements (i.e. the portion on the first unit and the portion on the second unit) must be separately aligned and fastened together, which is also time consuming and requires use of both hands. Accordingly, attachment and detachment of the first and second units of the '903 lacks speed and efficiency.

The '279 patent is directed to a dual unit handbag having a top compartment and a removable lower compartment. The top compartment is connected to the bottom compartment by a suitable connection means such as a zipper. While attached to the top compartment, the bottom compartment remains open at its top. The bottom compartment having an open top while attached to the top compartment is disadvantageous for a few reasons. First, for example, if the bottom compartment inadvertently becomes either partially or fully detached from the top compartment, items contained therein can fall out and become lost. Second, because the bottom compartment remains open at its top during attachment to the top compartment, it may be awkward to maneuver the bottom compartment during the top and bottom compartment attachment process. For example, a person trying to align the zipper elements of the top and bottom compartments may find it difficult to achieve proper alignment without moving the bottom compartment into a position that may result in items within the bottom compartment falling out of the bottom compartment or getting in the way during zipper alignment. Another disadvantage of the bottom compartment remaining open at its top end during attachment to the top compartment is similar to that described above for the '903 patent, namely, the mechanisms to attach the compartments to one another cannot be located on the bottom and top surfaces of the top and bottom compartments, respectively, which is disadvantageous for the reasons discussed above.

A further disadvantage with the handbag of the '279 patent is that there is no way to gain access to the contents contained within the bottom compartment other than through its open top. Accordingly, if a person wants to add or remove an item to/from the bottom compartment, a user must at least partially disconnect or unzip the connection means between the two compartments. This can be problematic because items can fall out of the bottom compartment during this process. A further disadvantage with the handbag of the '279 patent is with the use of a zipper as the attachment mechanism between the top and bottom compartments. Because a zipper is the attachment mechanism between the top and bottom compartments, much loading and thus stress is exerted on the zipper from the weight of the items contained in the bottom compartment. Accordingly, the zipper may open up during use or even prematurely fail resulting in a bag that does not achieve its intended purpose. Further, attaching the top and bottom compartments together with a zipper when the bottom compartment is completely detached may be problematic. For example, if the bag is being used as an infant or child carrying bag, it may be impossible to attach the two compartments together. Usually, a person with a child only has one hand available to do things as the other hand is being used to hold the child. Therefore, aligning and engaging the two separate components of the zipper with a single hand may be very difficult, if not impossible and time consuming.

Accordingly, a need exists to provide an alternative to current carrying or tote bags. More specifically, a need exists for a carrying bag that can easily organize a plurality of small and large items such that a user may easily and more quickly locate desired items contained within the carrying bag. Furthermore, there is a need for a carrying bag that allows a user to separate larger bulkier items from smaller items and in which a user can easily detach the portion containing the larger bulkier items from the portion containing the smaller items.

SUMMARY OF THE INVENTION

For the reasons included above, it is therefore a principal object of embodiments of the present invention to provide a carrying bag in which a user can organize a plurality of small and large items such that the user may easily and more quickly locate desired items contained therein.

It is a further object of embodiments of the present invention to provide a carrying bag that allows a user to separate smaller items from larger, bulkier items.

Yet another object of embodiments of the present invention is to provide a carrying bag that is separated into at least a top portion and a bottom portion.

A further object of embodiments of the present invention is to provide a carrying bag that is separated into at least a top portion and a bottom portion where the top portion may be used to carry smaller and necessary items and the bottom portion may be used to carry larger items.

A still further object of embodiments of the present invention is to provide a carrying bag having at least a top portion and a bottom portion that prevents commingling of items.

A further object of embodiments of the present invention is to provide a carrying bag that is separated into at least a top portion and a bottom portion where the bottom portion is detachable from the top portion.

Yet another object of embodiments of the present invention is to provide a carrying bag that is separated into a fully enclosed top portion and a fully enclosed detachable bottom portion that allows a user to use the top portion and the bottom portion independently of one another whether or not they are attached to one another.

Another object of embodiments of the present invention is to provide a carrying bag that is separated into at least a top portion and a fully enclosed bottom portion where the bottom portion can act as a self-contained bag.

A still further object of embodiments of the present invention is to provide a carrying bag that is separated into at least a top portion and a fully enclosed bottom portion where the bottom portion can be detached from the top portion such that the bottom portion can be stowed separately.

Yet another object of embodiments of the present invention is to provide a carrying bag, which includes a structure that allows a user to further organize smaller items contained therein.

A further object of embodiments of the present invention is to provide a carrying bag having at least a top portion, which includes a removable structure that divides the top portion into at least two distinct sides or areas with each side being color coded allowing a caregiver or user to easily identify, for example, a child side and a caregiver side.

These and other objects and advantages are provided by the instant invention. In this regard, the present invention is directed to a carrying bag having a top portion with at least two side walls, a closable top, a closed bottom having an exterior bottom surface and an interior top compartment, a detachable bottom portion with at least two side walls, a closed top having an exterior top surface, a closed bottom, an interior bottom compartment and at least one access opening into the interior bottom compartment, and a compartmentalized structure having a plurality of individual compartments. In order to attach the top and bottom portions together, a means for attaching the portions together comprising a first component and a second component attached to the top and bottom portions of the bag 2 is included.

In one embodiment, the means for attaching the top and bottom portions together may be a track system where the first and second components are male and female tracks that have corresponding geometries, which slidingly engage one another. In another embodiment, the first component may be a female track and the second component may comprise at least on post-type male element that slidingly engages the female track. In a further embodiment, the first component may be a shaped opening and the second component may be a locking member having a complementary shape to that of the shaped opening such that it can be received and rotated within the shaped opening, thereby joining the top and bottom portions of the carrying bag together. In order to conceal the juncture between the top portion and the bottom portion of the carrying bag, an apron may be included.

The compartmentalized structure, which may be included in the top or bottom portion, may be removably attached to the top or bottom portion by way of an attaching device or a means for attaching such as, for example, a track system, snaps, zippers, buttons and hook and loop fasteners. In one embodiment, the compartmentalized structure may be positioned within the top portion of the bag such that the interior top compartment is divided into two separate and distinct areas—one area is located between the compartmentalized structure and one side wall of the top portion and the other area is located between the compartmentalized structure and the other side wall of the top portion. The two separate and distinct areas on either side of the compartmentalized structure can be used to store, for example, baby or child items on one side and caregiver or user items on the other side. In order to allow a user to quickly identify which distinct area is for the caregiver or user and which is for the baby or child, each area can be a different color.

The various features of novelty which characterize the invention are pointed out in particularity in the claims annexed to and forming a part of this disclosure. For a better understanding of the invention, its operating advantages and specific objects attained by its uses, reference is made to the accompanying descriptive matter in which preferred embodiments of the invention are illustrated in the accompanying drawings.

BRIEF DESCRIPTION OF THE DRAWINGS

Preferred features of the present invention are disclosed in the accompanying drawings, wherein similar reference characters denote similar elements throughout the several views, and wherein.

DESCRIPTION

Figure 1A:
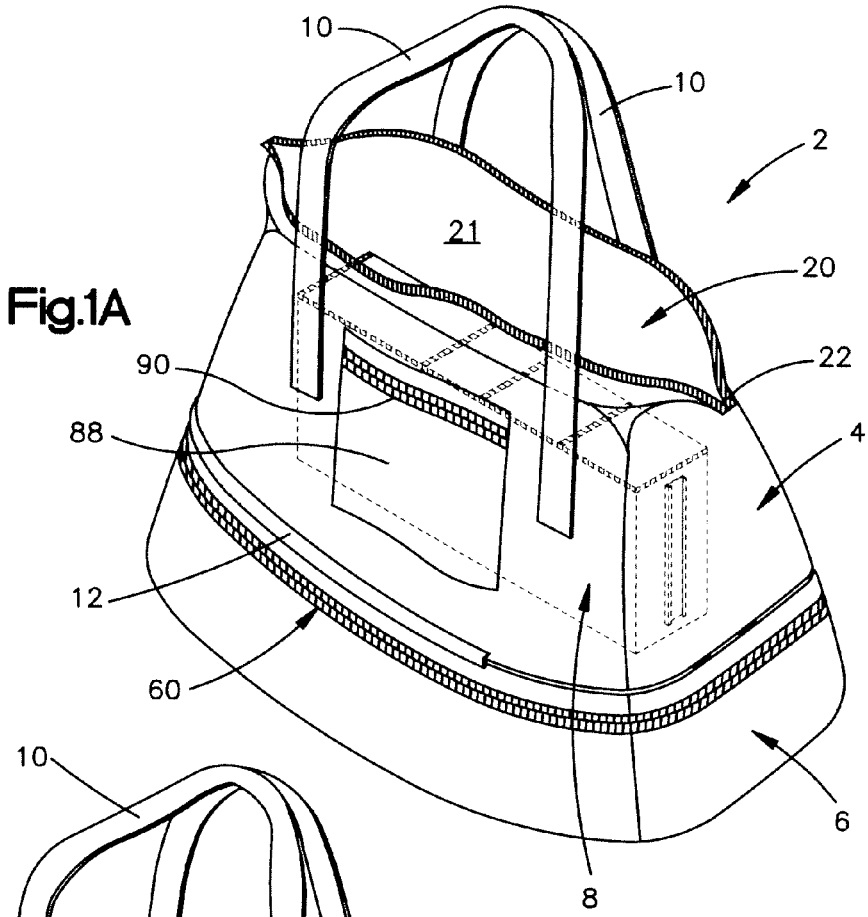
FIG. 1A is a front perspective view of a carrying bag with its top open, according to one embodiment of the present invention.

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete and will fully convey the scope of the invention to those skilled in the art.

In the following description, like reference characters designate like or corresponding parts throughout the figures. Additionally, in the following description, it is understood that terms such as "top," "bottom," "upper," "lower," "first," "second," and the like, are words of convenience and are not to be construed as limiting terms.

Embodiments of the present invention are directed to multi-portion carrying or tote bags having a top portion and a fully detachable bottom portion. As used herein, the terms "carrying bag," "tote," "tote bag" and "bag," and "user," caregiver" and "person," are used interchangeably. The present carrying bags can be made of a durable material, such as canvas, nylon, vinyl, leather, or any other materials or fabrics known in the art that are suitable for making such a bag. It is also possible for the present carrying bag to be made from a combination of materials having different properties such as strength, softness, insulating characteristics, waterproof characteristics, etc. Preferably, the present invention can be used as a tote bag to carry and organize items for an infant or child, such as diapers and creams, children's clothes, shoes, pacifiers, baby formula, baby food, snacks, bottles, sippy cups, blankets, toys, stuffed animals, books, electronic equipment such as a DVD player, DVDs as well as items for the child's caregiver, for example, PDAs, cell phones, keys, wallets, check books and the like. Accordingly, the present invention will now be described as a carrying bag for carrying baby and child items, however, it may be embodied as a handbag, travel bag, gym bag, sports bag for use in all types of sports such as, for example, baseball, softball, football, soccer, bowling, golf, fishing, etc, or other carrying or tote bag.

Figure 1B:
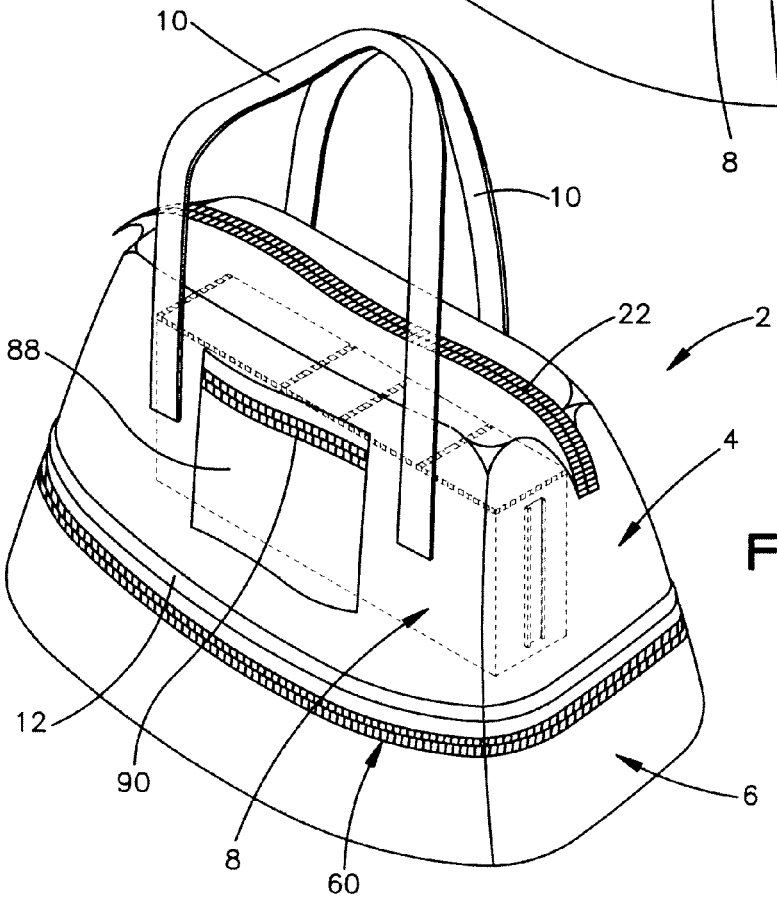
FIG. 1B is a front perspective view of a carrying bag with its top closed, according to one embodiment of the present invention.
Figure 1C:
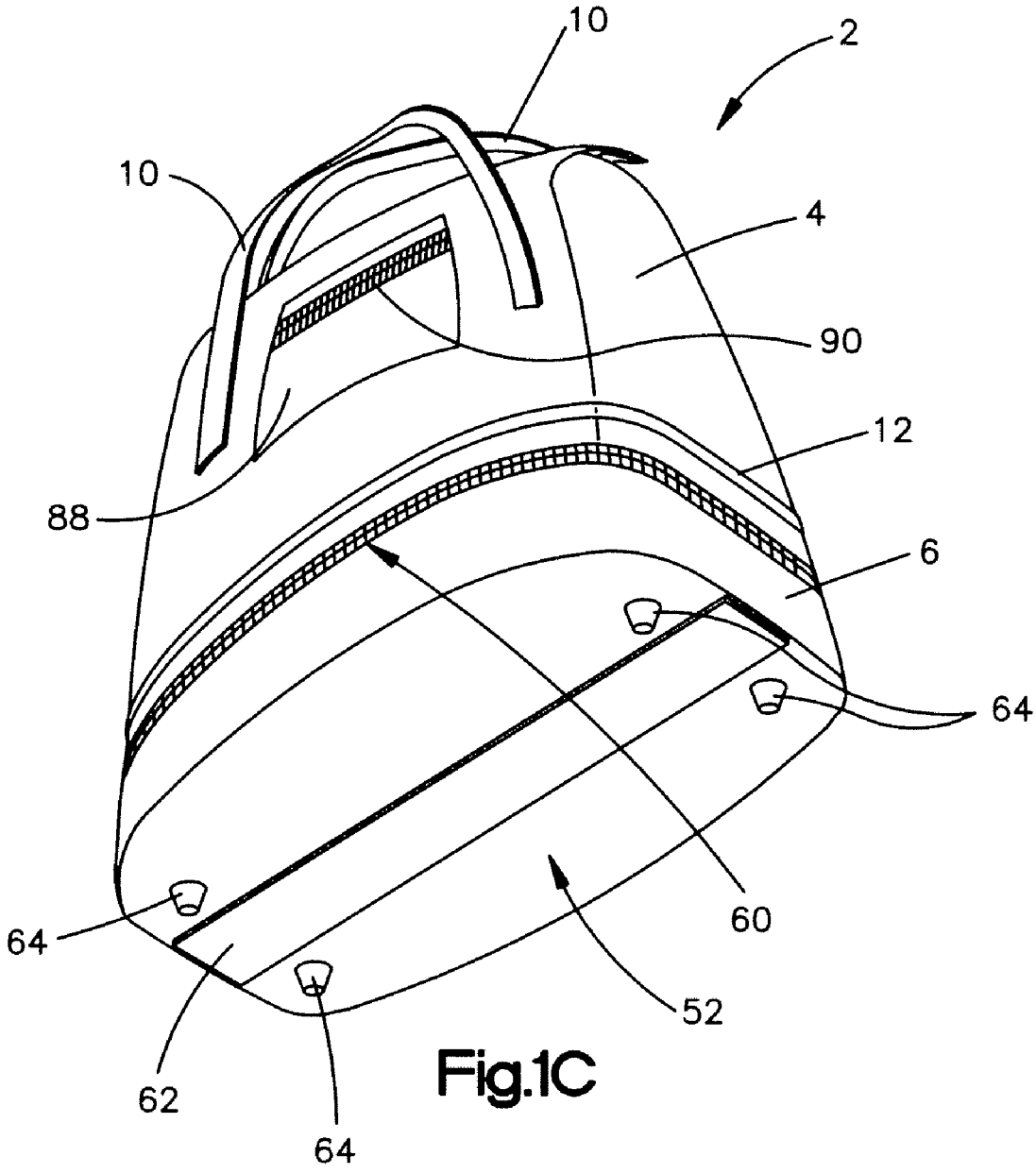
FIG. 1C is a front perspective view from below of a carrying bag, according to one embodiment of the present invention.

The present invention addresses the previously discussed problems associated with existing carrying or tote bags that are used to carry a multitude of small and large items, by separating the larger bulkier items from the smaller items and then further organizing the smaller items into individual compartments designed for specific or key items. Accordingly, as depicted in FIGS. 1A-1C, in one embodiment, the present carrying bag 2 comprises at least three major components: a top portion 4; a detachable bottom portion 6; and a compartmentalized structure 8 located within the top portion 4. The carrying bag 2 also includes at least one, and more preferably two, carrying straps 10 that can be handheld or over-the-shoulder straps and may, in another embodiment, even be back-pack type straps. Further, an apron 12 may be included on the exterior of the bag 2 at the junction between the top portion 4 and the detachable bottom portion 6.

Figure 2:
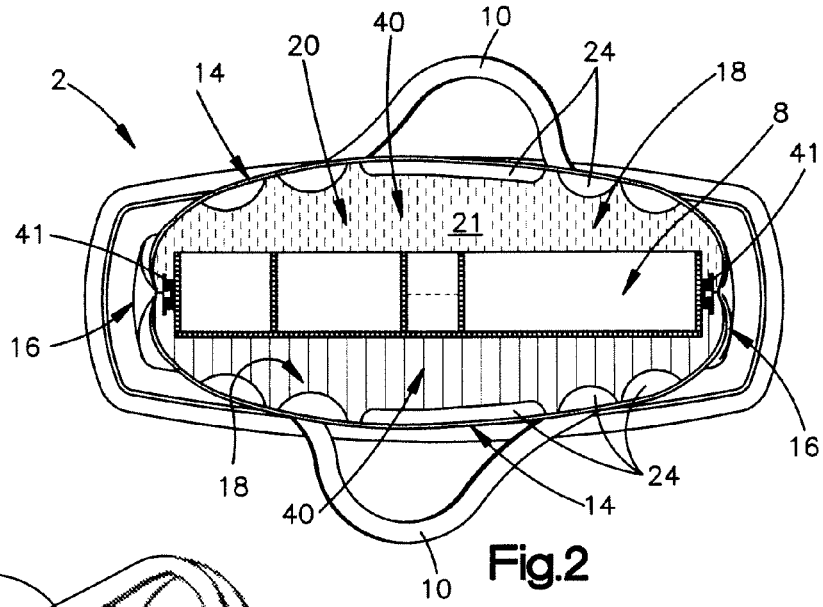
FIG. 2 is a top plan view of a carrying bag with its top open, according to one embodiment of the present invention.

As can be seen in the figures, and more specifically FIG. 2, the top portion 4 has at least two side walls 14, two end portions 16, a closed bottom 18, and an open top 20 that provides access to a large open interior compartment or bucket portion 21 in which the compartmentalized structure 8 is disposed. In order to close the open top 20, a closure device 22 or means for opening and closing the open top 20, such as, for example, a zipper, is provided. The zipper 22 may be a one way zipper opening from a single end of the top portion 4 or it may be a two way zipper opening from each end of the top portion 4. As will be readily apparent to those skilled in the art, other types of closure devices or means for opening and closing the open top 20 such as hook and loop fasteners (VELCRO®), snaps, buttons, clasps, etc., may be used to close the open top 20. The interior compartment or bucket portion 21 may also include pockets 24 of various sizes, shapes and materials (canvas, nylon, netting, mesh, micro fiber, plastic, etc.), attached to the interior surfaces of the side walls 14. These pockets 24 are designed to further organize smaller items such as pacifiers, keys, cell phones, wallets, medicine, etc., and may include closure devices such as zippers, snaps, buttons, hook and loop fasteners (VELCRO®) or any other suitable closure device known in the art or, the pockets 24 may be elastic, in order to prevent the items contained therein from falling out and becoming commingled.

Figure 4A:
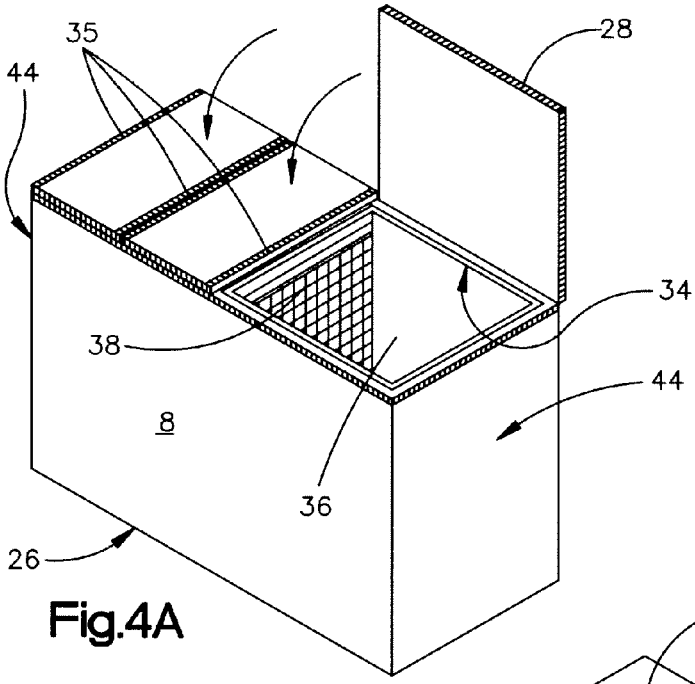
FIG. 4A is a front perspective view of a compartmentalized structure, according to one embodiment of the present invention.
Figure 4B:
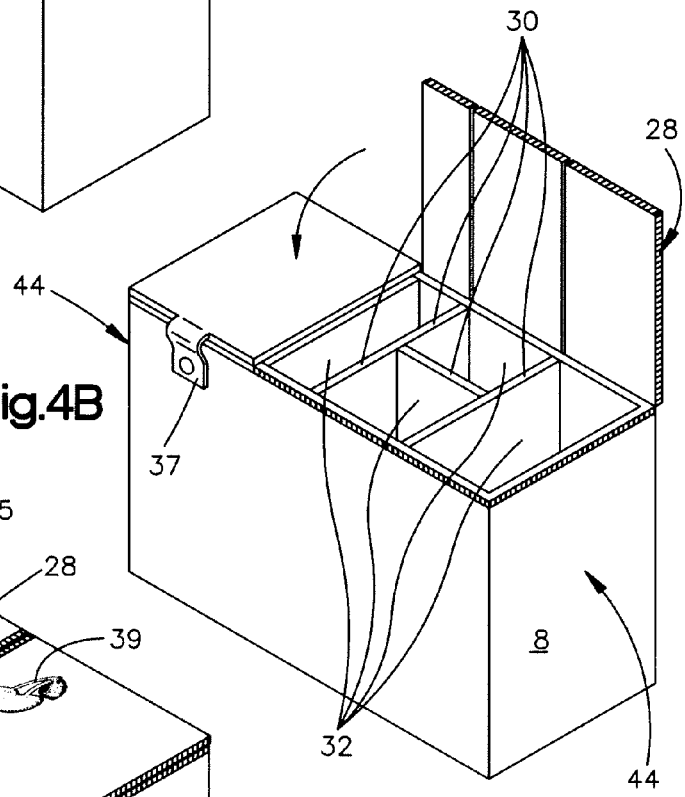
FIG. 4B is a front perspective view of a compartmentalized structure, according to one embodiment of the present invention.
Figure 4C:
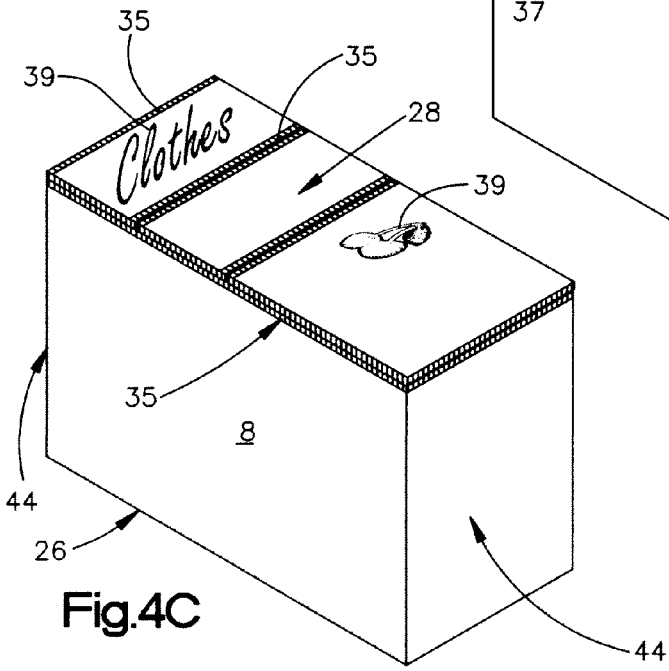
FIG. 4C is a front perspective view of a compartmentalized structure, according to one embodiment of the present invention.

As depicted in FIGS. 4A-4C, the compartmentalized structure 8 comprises a bottom 26, a top cover or lid 28 and a plurality of walls or partitions 30, which form a plurality of individual compartments 32. The bottom 26, top cover or lid 28 and walls or partitions 30, may be formed from a substantially rigid material such as, for example, plastic, etc., which may or may not include a covering material such as canvas, nylon, vinyl, micro fiber, leather, etc. The covering material may be waterproof and may include an antimicrobial coating. The compartmentalized structure 8 can be designed to have any number and configuration of individual compartments 32 to hold and store items such as diapers, wipes, creams, a change of clothes, etc. Depicted in FIGS. 4A-4C are but two examples of compartmentalized structure 8 configurations. As will be readily apparent to those skilled in the art, the compartmentalized structure 8 can be of numerous configurations. In addition, one or more of the individual compartments 32 may be designated as a food compartment and may include an insulating material 34 to keep bottles warm or food and drinks cold. The top cover or lid 28 may be subdivided so that particular portions of the compartmentalized structure 8, such as the insulated compartment(s) 36, can be opened and closed independently from the other compartments 32. The subdivided cover or lid 28 may include a closure device 35, such as, for example, a zipper to allow portions of the cover 28 to be opened and closed independently of the other portions of the lid 28. Other closure devices such as a latch-type mechanism 37 may also be used. The insulated compartments 36 should be large enough both in their width and depth to hold capped baby bottles, sippy cups, food and other items requiring thermal insulation. The individual compartments 32 may also include loops or pockets of material, insulating material, mesh or netting 38, which may be elastic, to hold utensils, straws and other small items.

The individual compartments 32 may also include item identifiers 39 such as, for example, item names, words, phrases, symbols, pictures and drawings (i.e. a compartment designed to hold a bottle may include a picture or bottle design and a compartment designed to hold food may include a picture or a design depicting cherries, bananas, grapes, or the like). The item identifiers 39 may be of any design type and may be, for example, sewn on, embroidered or they may be patches, and will typically be included on the top cover or lid 28 to allow a user to easily identify which compartments 32 contain which items. These item identifiers may also be included on any of the carrying bag's pockets.

In one embodiment, the compartmentalized structure 8 may be disposed lengthwise down the middle of the top portion 4 thereby separating the interior compartment or bucket portion 21 into two distinct areas 40 as shown in FIG. 2. In this configuration, smaller items, such as pacifiers, may be included in the pockets 24 along the interior walls of the top portion 4 and larger items such as stuffed animals, books, toys, baby blankets, etc., which have been removed from the bottom portion 6 for use, may be temporarily stored in the areas 40 between the compartmentalized structure 8 and the side walls 14 of the top portion 4. Also in this configuration, the pockets 24 and area 40 on one side of the top portion 4 may be dedicated to baby or child items while the pockets 24 and area 40 on the other side of the top portion 4 may be dedicated to caregiver or user items such as a wallet, keys, cell phone, etc., thereby further organizing and preventing commingling of the baby or child items with the caregiver's items. If the top portion 4 is separated into two distinct sides, one for a baby or child and the other for a caregiver, different color material or materials having a texture, may be used for the interior portions of each side 40 of the bag 2 in order to help a user quickly identify which side of the bag 2 is the child side and which side of the bag is the user or caregiver side. For example, the child side may be color coded pink and the caregiver side may be color coded red. Additional compartmentalized structures 8 may be added to alter the configuration of the top portion's 4 open area or bucket portion.

Figure 3A:
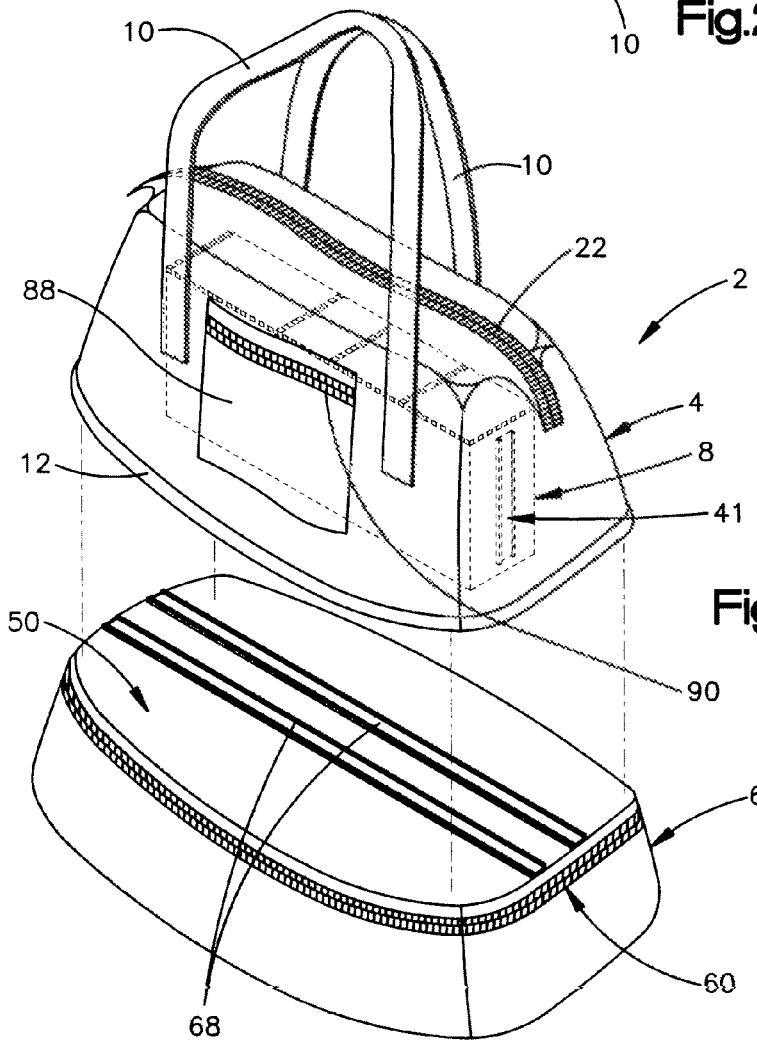
FIG. 3A is an exploded front perspective view of a carrying bag with the top portion detached from the bottom portion, according to one embodiment of the present invention.
Figure 3B:
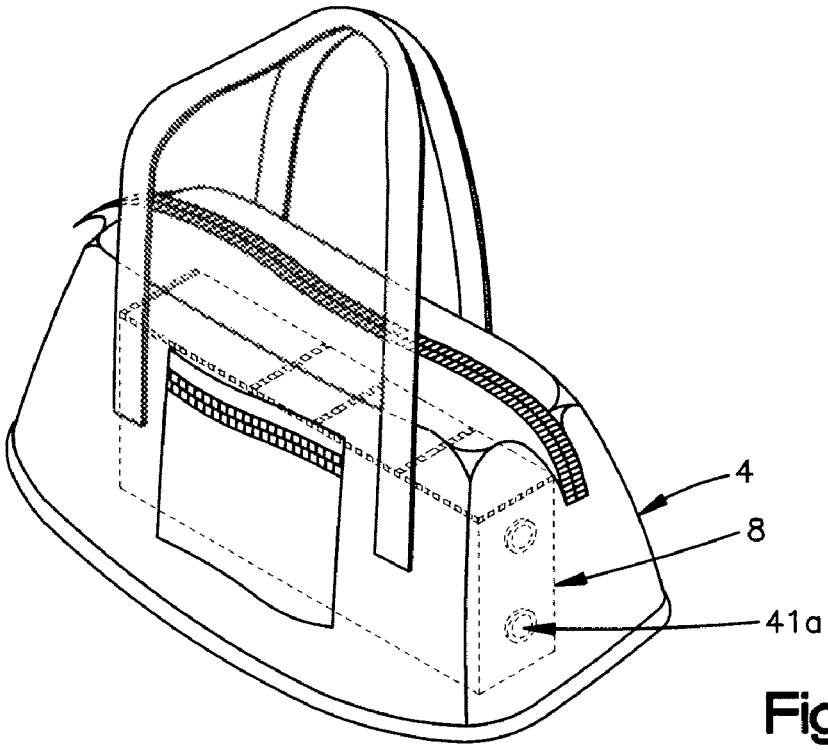
FIG. 3B is an exploded front perspective view of a carrying bag with the top portion detached from the bottom portion, according to one embodiment of the present invention.
Figure 3C:
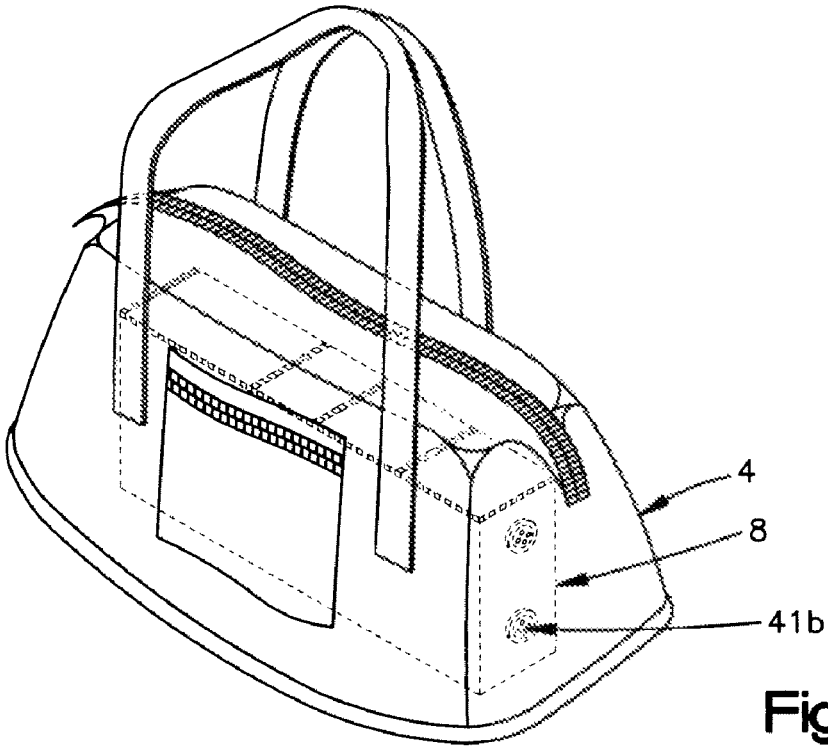
FIG. 3C is an exploded front perspective view of a carrying bag with the top portion detached from the bottom portion, according to one embodiment of the present invention.
Figure 3D:
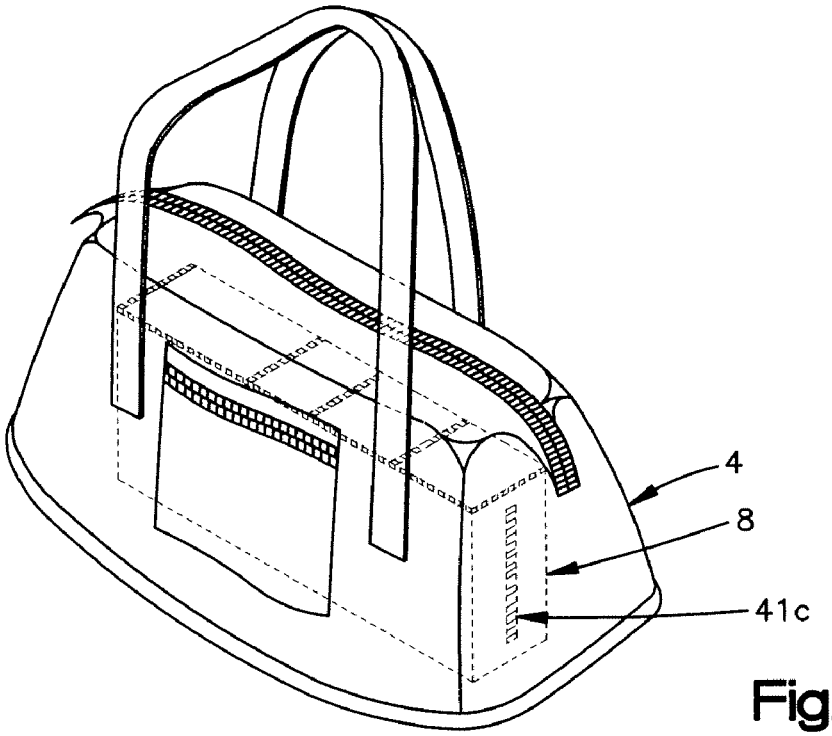
FIG. 3D is an exploded front perspective view of a carrying bag with the top portion detached from the bottom portion, according to one embodiment of the present invention.
Figure 3E:
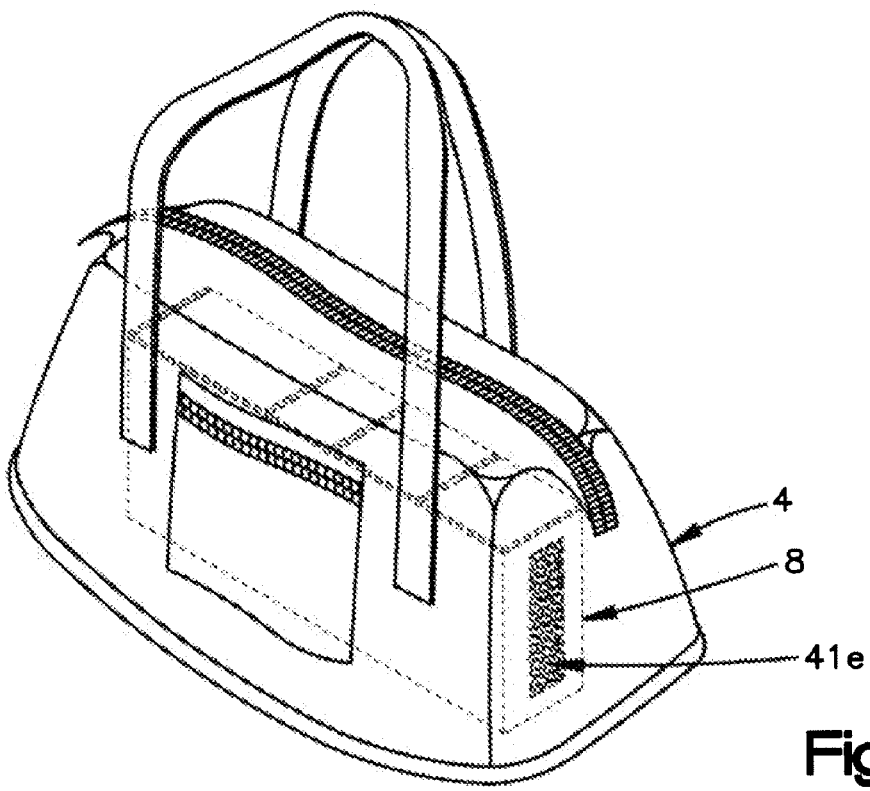
FIG. 3E is an exploded front perspective view of a carrying bag with the top portion detached from the bottom portion, according to one embodiment of the present invention.
Figure 3F:
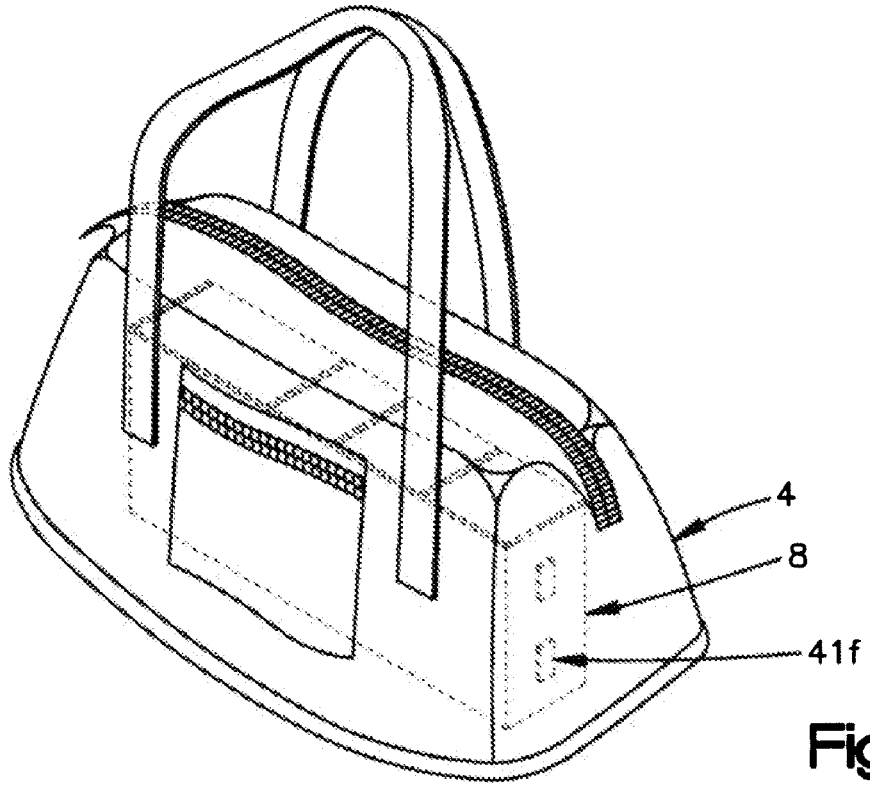
FIG. 3F is an exploded front perspective view of a carrying bag with the top portion detached from the bottom portion, according to one embodiment of the present invention.
Figure 5A:
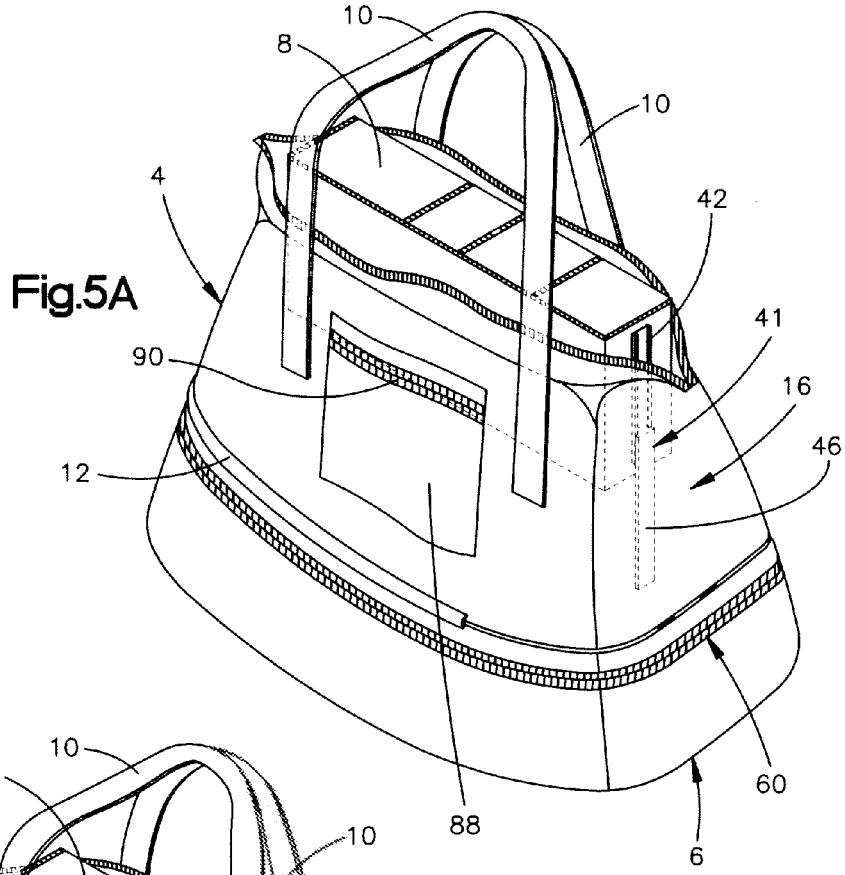
FIG. 5A is a front perspective view of a carrying bag with its compartmentalized structure partially removed, according to one embodiment of the present invention.
Figure 5B:
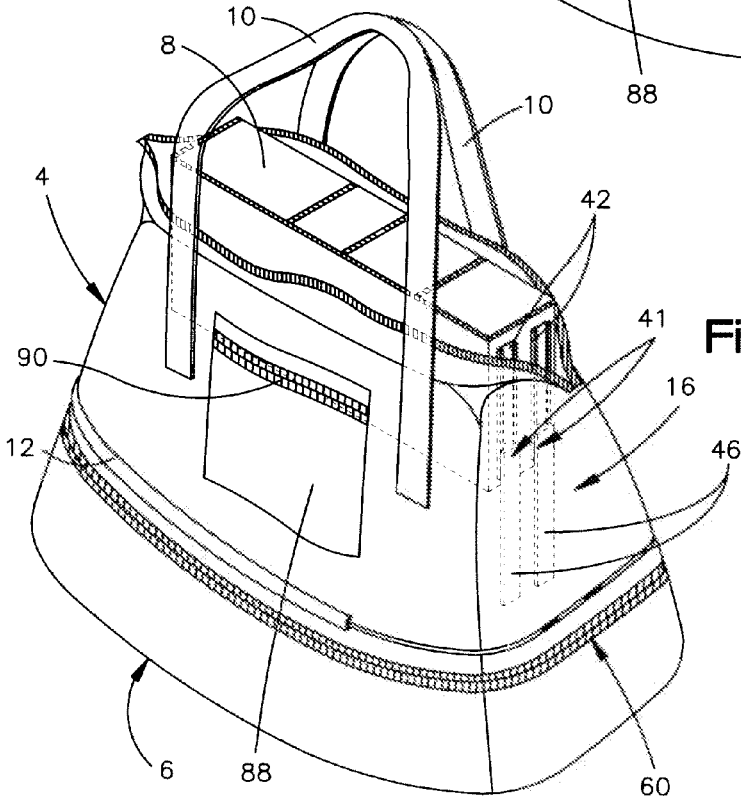
FIG. 5B is a front perspective view of a carrying bag with its compartmentalized structure partially removed, according to one embodiment of the present invention.

In one embodiment, as depicted, for example in FIG. 3A, the compartmentalized structure 8 may be removably attached to the interior of the top portion 4 by way of a track system 41, similar to that disclosed below. Accordingly, as depicted in FIG. 5A, a first component 42 of the track system 41 may be attached to each end 44 (shown in FIGS. 4A-4C) of the compartmentalized structure 8 and the corresponding second component 46 of the track system may be attached to the interior of each end portion 16 of the top portion 4 of the carrying bag 2, thereby allowing a user to simply slide the compartmentalized structure 8 in and out of the top portion 4. As depicted in FIG. 5B, a plurality of substantially parallel first 42 and second 46 track components may be used to removably attach the compartmentalized structure 8 to the interior of the top portion 4. Because, as depicted in the figures, embodiments of the present invention may include a top portion 4 of the bag 2 that is trapezoidal-shaped, a triangular-shaped extension of material may be included on each end portion 16 on the interior of the top portion 4 of the bag 2 such that the first 42 and second 46 track components may be parallel to and aligned with each other.

As depicted in FIGS. 3B-3F, additional means for removably attaching the compartmentalized structure 8 to the top portion 4 such as snaps 41*a*, buttons 41*b*, zippers 41*c*, hook and loop fasteners (VELCRO®) 41*e*, magnets 41*f*, or the like, may also be used. For example, in the embodiment depicted in the figures where the compartmentalized structure 8 is disposed lengthwise down the middle of the top portion 4, one component of the means for attaching may be included on the bottom and sides of the compartmentalized structure 8 and the corresponding component of the means for attaching may be included on the closed bottom 18 and interior end portions 16 of the top portion 4. Removably attaching the compartmentalized structure 8 to the top portion 4, allows a user the ability to remove the compartmentalized structure 8 to, for example, clean it or use it separately from the bag 2.

Figure 5C:
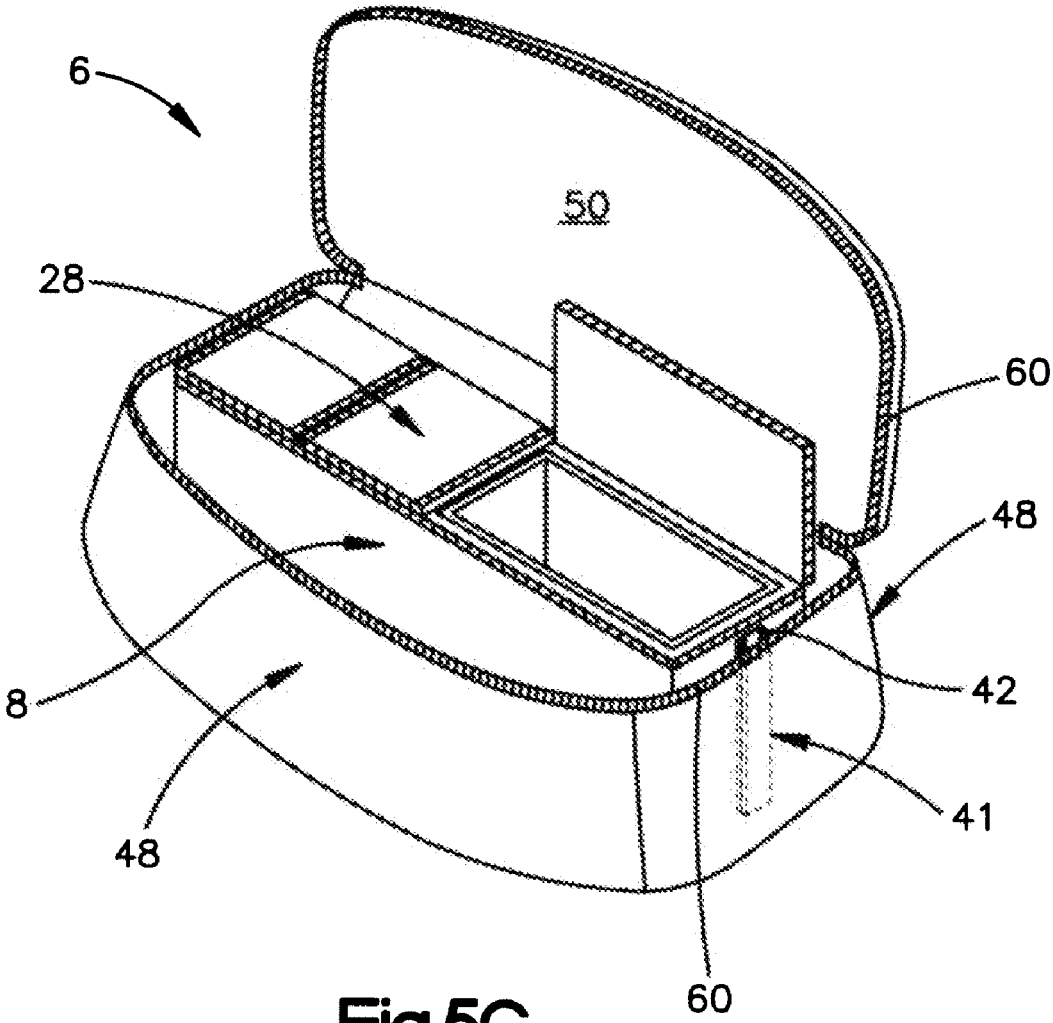
FIG. 5C is a front perspective view of an open bottom portion of the carrying bag, according to one embodiment of the present invention.

Further, in one embodiment, the compartmentalized structure 8 may be attached or disposed within the top portion 4 such that items contained within the areas 40 on each side of the structure 8, are prevented from migrating from the area 40 on one side of the structure 8 to the area 40 on the other side of the structure 8. Accordingly, commingling of caregiver and child items is prevented. This can be achieved either by attaching the compartmentalized structure 8 to the interior surface of the top portion's 4 closed bottom 18 and end portions 16 or otherwise assuring that there are no gaps or spaces between the structure 8 and the interior surfaces of the top portion 4 for the items to pass through. Additionally, the compartmentalized structure 8 may be disposed within a partial or full pocket, which may be sewn or otherwise attached to the interior surface of the top portion's 4 closed bottom 18 and the interior surfaces of the end portions 16 such that there are no gaps or spaces between the structure 8 and the interior surfaces of the top portion 4. As will be readily apparent to those skilled in the art, as depicted in FIG. 5C, the compartmentalized structure 8 may also be included in the bottom portion 6 of the carrying bag 2. Accordingly, the above disclosures related to the compartmentalized structure 8 being disposed in the top portion 4 is also applicable to embodiments of the present invention where the compartmentalized structure 8 is disposed in the bottom portion 6.

Turning now to the bottom portion 6, as can be seen in, for example, FIGS. 3, 6A, 6B and 6C, the bottom portion 6 is a completely enclosed integral structure comprising at least two side walls 48, a closed top 50, a closed bottom 52, and a large interior compartment or bucket portion 54 used to store large bulky items such as blankets, shoes, jackets, stuffed animals, books and the like. To help further organize items contained within the bottom portion 6, at least one pocket 56 may be included on the interior of the side walls 48 that may be made of a mesh or other material. In order to permit access to the interior compartment 54 of the bottom portion 6, closure device 60 or means for opening and closing the interior compartment 54, such as a zipper (which may be a one or two way zipper), defining an access opening, is provided. As will be readily apparent to those skilled in the art, additional closure devices may include, but are not limited to, snaps, buttons, clasps and hook and loop fasteners (VELCRO®). As can be seen in the embodiments depicted in the figures, it is preferable that the closure device 60 and access opening extend for a distance around the perimeter of the bottom portion 6 that allows a user easy access to the interior compartment 54. For example, the access opening and closure device 60 may extend approximately ¾ of the way around the perimeter of the bottom portion 6. An access opening and closure device 60 extending over this distance, allows a user easy access to the interior compartment 54 of the bottom potion 6 to add and remove the large bulky items. Further, as depicted in FIG. 7, an access opening and closure device 60 that extends, for example, approximately ¾ of the way around the perimeter of the bottom portion 6 also allows a user to completely open or undo the zipper or closure device 60 and fold the top portion 4 of the bag 2 over and back with the top portion 4 still attached to the bottom portion 6 thereby exposing the interior compartment 54 of the bottom portion 6, giving a user full access to the interior compartment 54 without detaching the top portion 4 from the bottom portion 6.

Figure 6A:
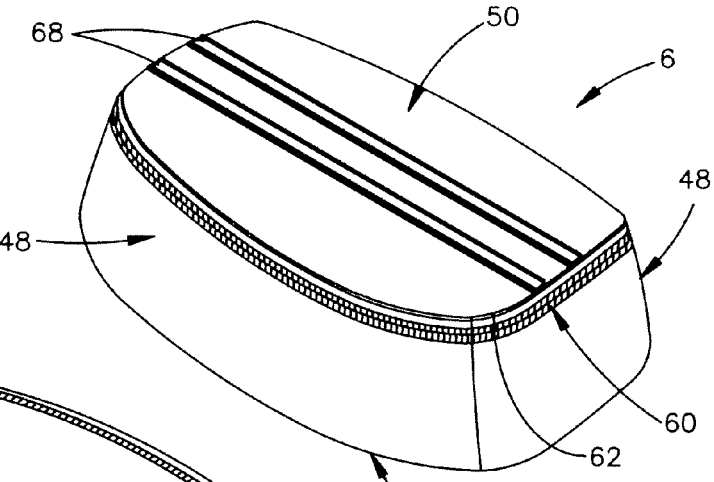
FIG. 6A is a front perspective view of the bottom portion of the carrying bag depicted in the previous figures.
Figure 6B:
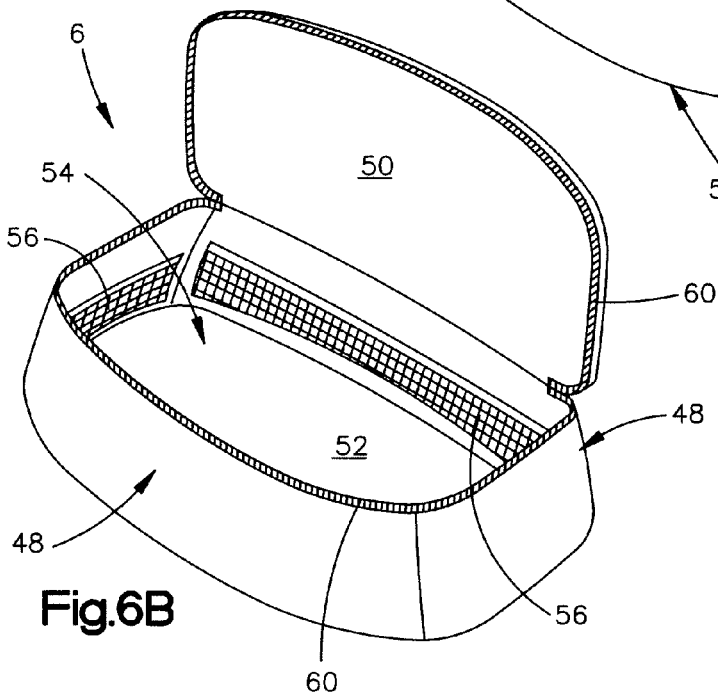
FIG. 6B is a front perspective view of an open bottom portion of the carrying bag depicted in the previous figures.
Figure 6C:
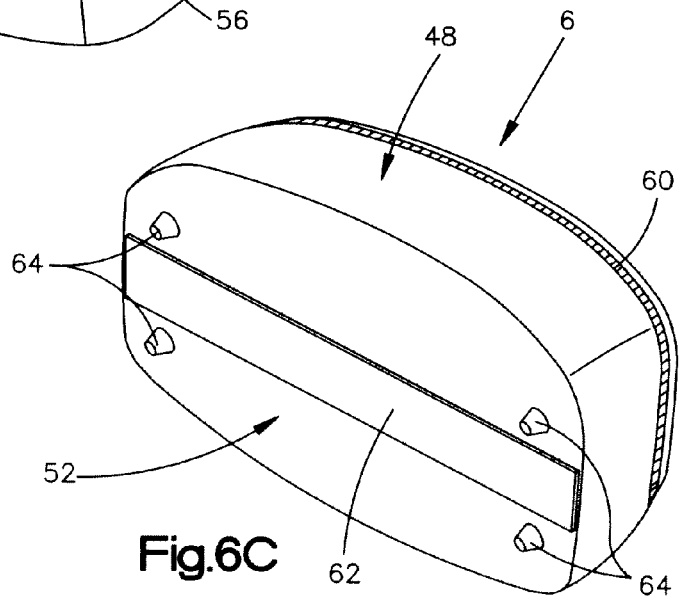
FIG. 6C is a bottom perspective view of the bottom portion of the carrying bag depicted in the previous figures.
Figure 7:
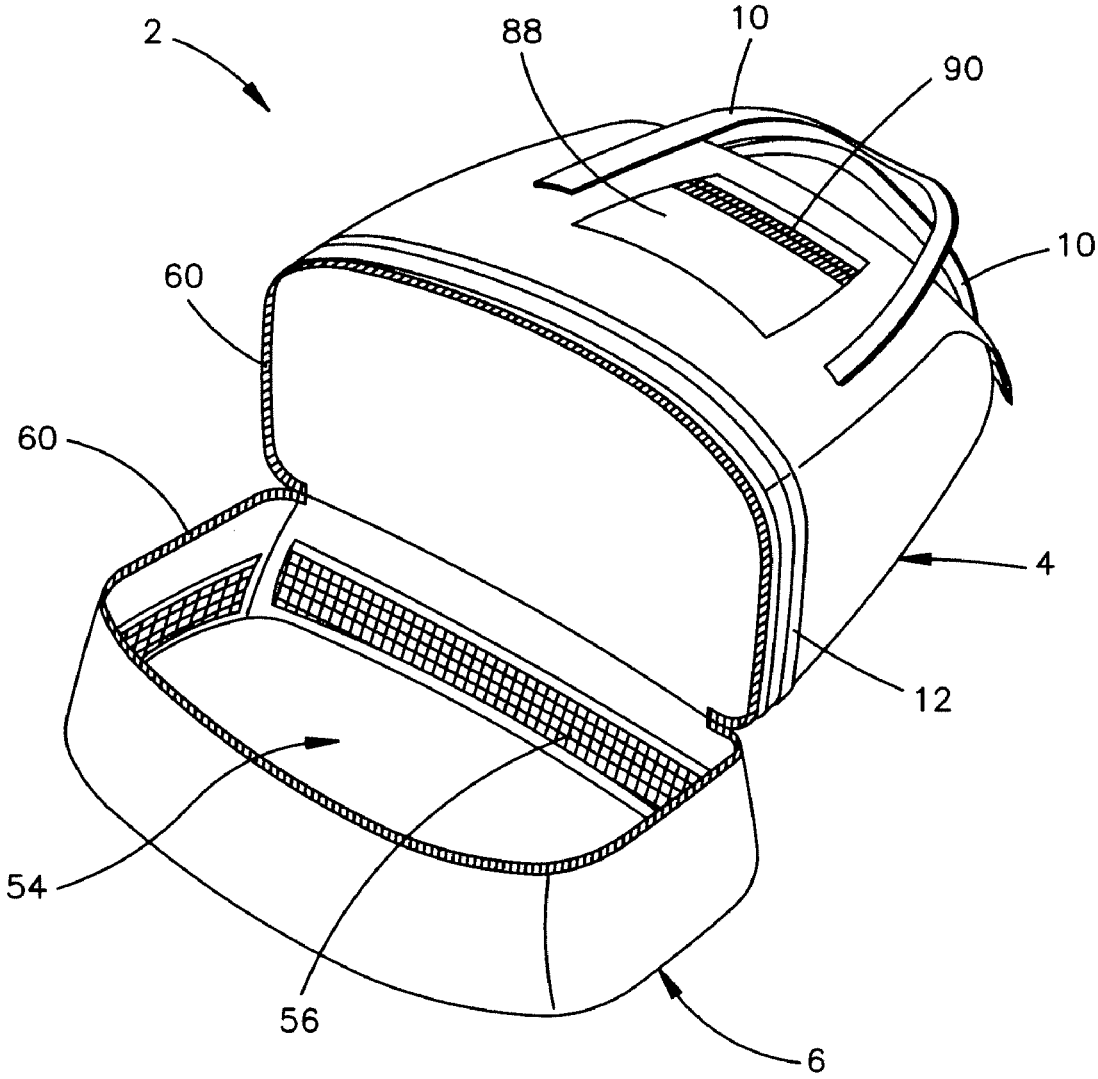
FIG. 7 is a front perspective view of the carrying bag depicted in the previous figures showing an open bottom portion with the top portion of the bag still attached to the bottom portion.

To help reinforce the bottom portion 6, as shown in FIG. 6C, a reinforcing material 62 such as rubber, plastic or the like, may be included on the closed bottom 52. The reinforcing material 62 may be included on the closed bottom's 52 exterior surface, interior surface or both, and may be a single strip of material, multiple strips of material or it may completely cover the interior or exterior bottom surfaces. Further, "feet" or supports 64 may be included on the exterior surface of the closed bottom 52 such that the "feet" 64 support the bottom portion 6 when the bag 2 is not being carried. To make transporting the carrying bag 2 easier and more manageable for a user, wheels, which may be retractable or foldable, may be included on the bottom portion 6 and a handle, which may also be retractable, may be included on the top portion 4 and/or bottom portion 6.

Figure 8A:
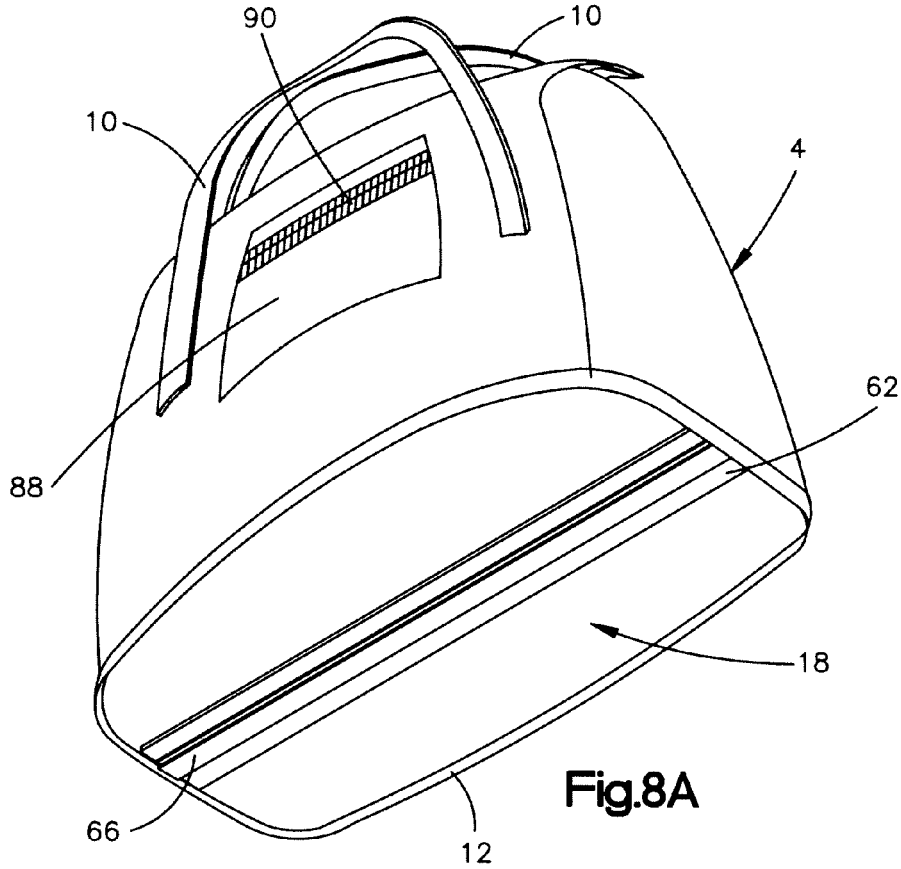
FIG. 8A is a bottom perspective view of the top portion of the carrying bag depicted in the previous figures showing a means for attaching the top portion and the bottom portion of the carrying bag to one another, according to one embodiment of the present invention.
Figure 8B:
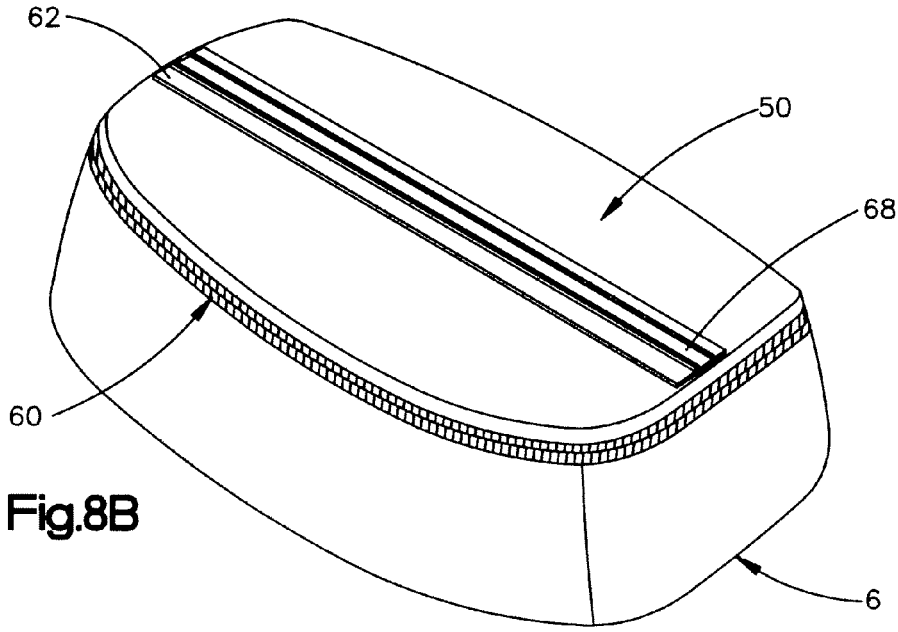
FIG. 8B is a front perspective view of the bottom portion of the carrying bag depicted in the previous figures showing a means for attaching the top portion and the bottom portion of the carrying bag to one another, according to one embodiment of the present invention.
Figure 8C:
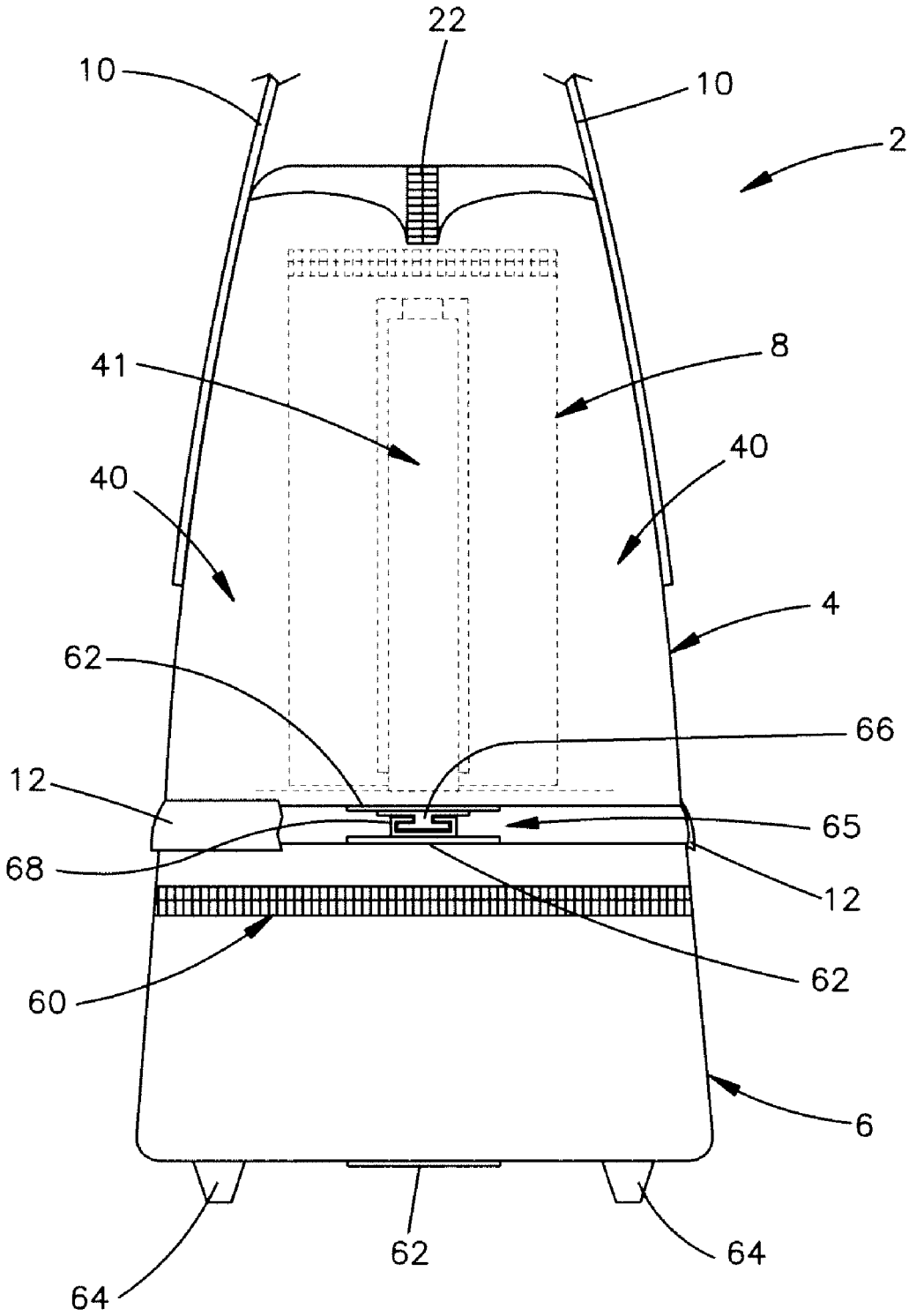
FIG. 8C is a side plan view of a carrying bag, according to one embodiment of the present invention.
Figure 9A:
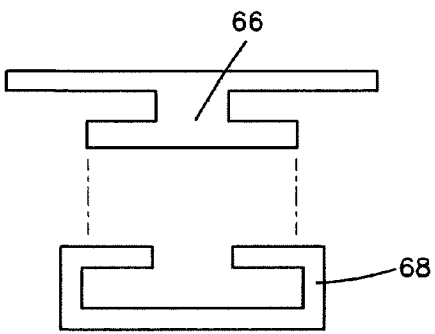
FIG. 9A is a side plan view showing the geometry of a track system used in a carrying bag, according to one embodiment of the present invention.
Figure 9B:
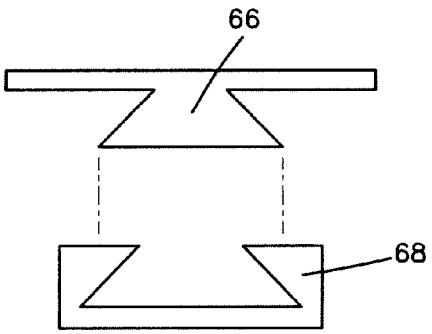
FIG. 9B is a side plan view showing the geometry of a track system used in a carrying bag, according to one embodiment of the present invention.

As previously disclosed, the bottom portion 6 is detachable from the top portion 4 of the carrying bag 2. FIGS. 8A, 8B and 8C depict one embodiment of an attaching device or means for detachably joining or connecting the top portion 4 of the carrying bag 2 to the bottom portion 6. As can be seen in the figures, the attaching device or means for detachably joining or connecting the top portion 4 of the carrying bag 2 to the bottom portion 6 is a track system 65 that includes male 66 and female 68 tracks or components. Sample track cross-sections are depicted in FIGS. 9A and 9B. As will be readily apparent to those skilled in the art, any track cross-section that allows the tracks to slidingly engage one another, may be used.

Figure 10:
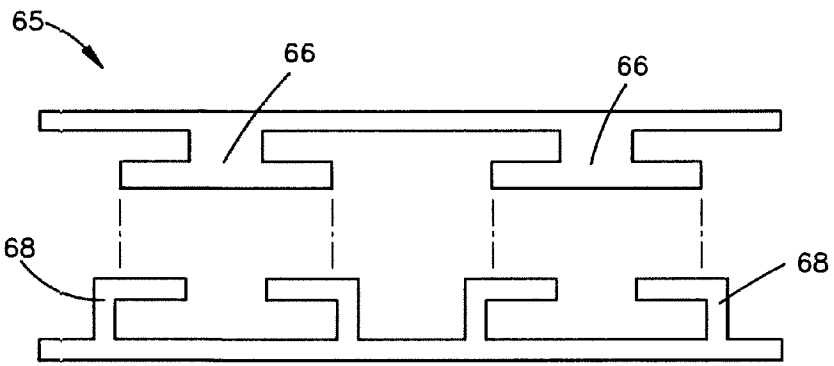
FIG. 10 is a side plan view of a track system used in a carrying bag, according to on embodiment of the present invention.

As shown in FIGS. 3, 8A, 8B and 8C, for example, one component of the track system 65, the male track component 66, for example, may be attached to the exterior bottom surface of the top portion's 4 closed bottom 18 and the corresponding female track component 68 of the track system may be attached to the exterior top surface of the bottom portion's 6 closed top 50. Accordingly, to connect or join the top portion 4 to the bottom portion 6, a user simply aligns the male 66 and female 68 track components of the track system with each other so the male track 66 is received within the female track 68, and then slides either the top portion 4 or bottom portion 6 with respect to the other so that the tracks slidingly engage one other, thereby joining the two portions of the carrying bag 2 together. Depicted in FIG. 8C is a side view of a bag 2 according to one embodiment of the present invention having a top portion 4 connected to a bottom portion 6 by way of the previously disclosed male 66 and female 68 track components. Although only one set of tracks is depicted in the figures, as shown in FIG. 10, a track system 65 comprising a plurality of substantially parallel side-by-side male 66 and female 68 tracks may also be used to join or connect the top portion 4 of the bag 2 to the bottom portion 6.

Figure 9C:
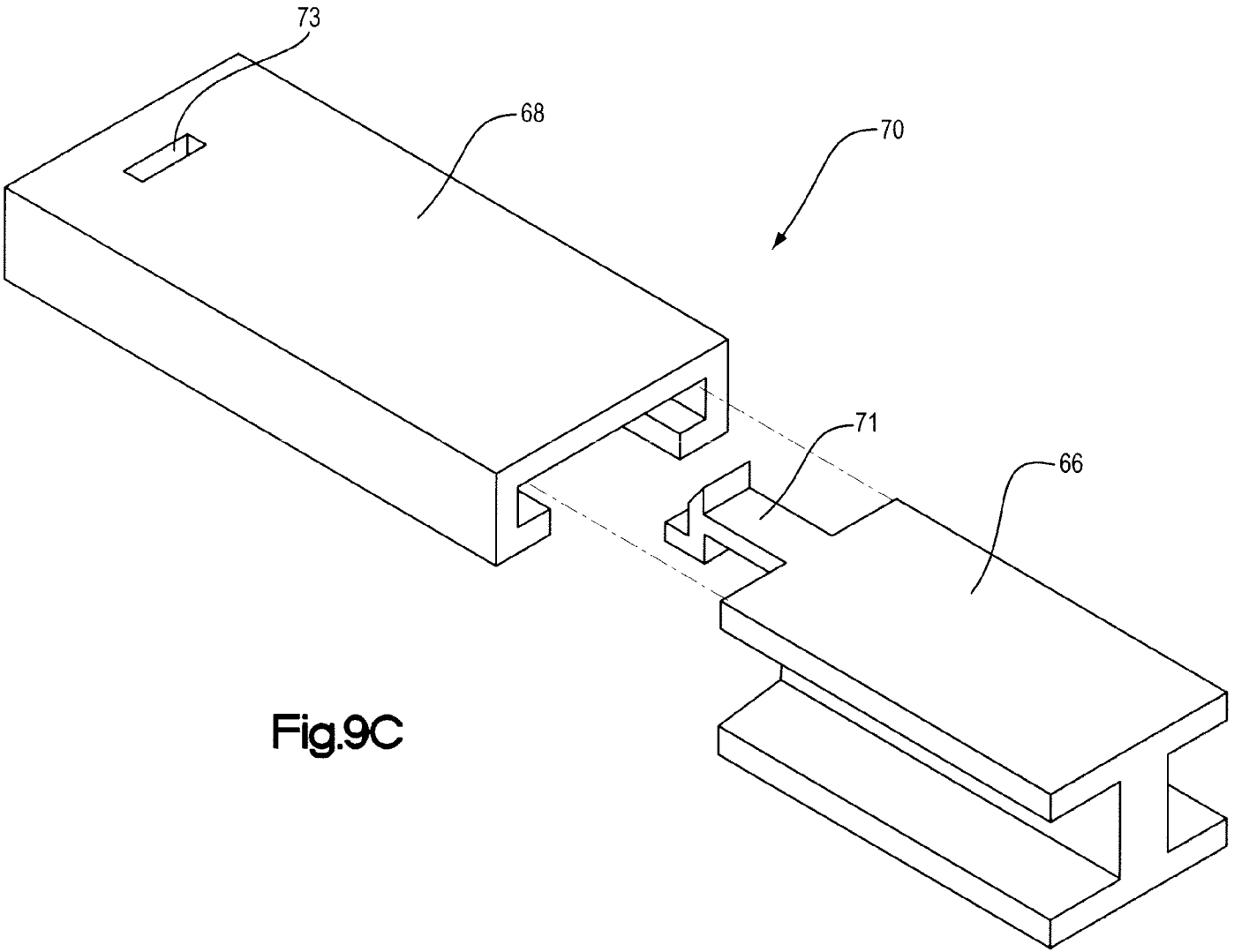
FIG. 9C is a front perspective view of a track locking device, according to one embodiment of the present invention.

As depicted in FIG. 9C, to secure the top portion 4 and the bottom portion 6 in place with respect to one another, a locking device 70 may be included on the track system. The locking device 70 may be, for example, an elastically deformable protrusion 71 on one of the track components, for example, the male track component 66, that engages a corresponding opening 73 in the other track component, for example, the female track component 68. When the protrusion 71 on one track component is engaged with the opening 73 in the other track component, movement of the tracks, and hence movement of the top 4 and bottom 6 portions of the carrying bag 2 with respect to one another, is prevented. To unlock the tracks thereby permitting the portions of the bag 2 to slide with respect to one another, the user causes the protrusion 71 of the locking device 70 on one track component to become disengaged from the opening 73 in the other track component. As will be readily apparent to those skilled in the art, any locking device that prevents movement of the track components with respect to each other, may be used.

Figure 11:
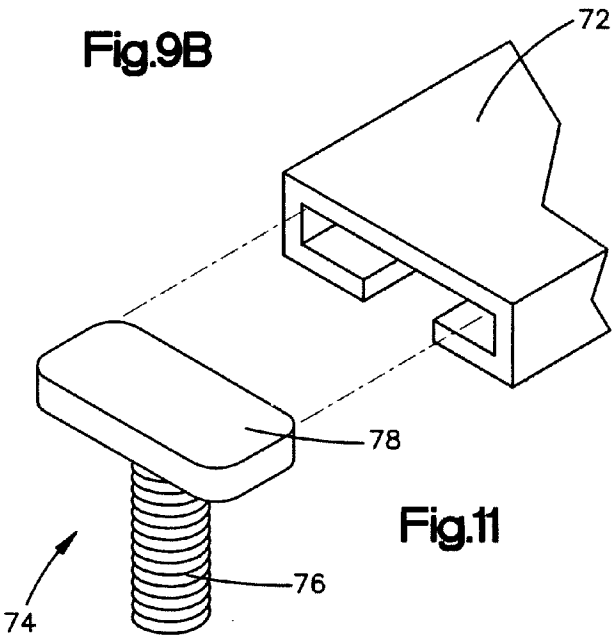
FIG. 11 is a front perspective view of a track system used in a carrying bag, according to one embodiment of the present invention.

As depicted in FIG. 11, another type of track system that may be used to attach the top portion 4 to the bottom portion 6 comprises a female track or component 72 and at least one post-type male element 74, and more preferably, a plurality of post-type male elements 74, each having at least a shaft 76 and a head portion 78 that is receivable within the female track 72, may be used. The female track 72 may be attached to the bottom surface of the top portion's 4 closed bottom 18 and the post-type element 74 may be attached to the top surface of the bottom portion's 6 closed top 50. Similar to the two track attaching device or means for detachably connecting the top portion 4 of the carrying bag 2 to the bottom portion 6 previously disclosed, a locking device may be included to lock the top portion 4 and the bottom portion 6 in place with respect to one another.

Figure 12:
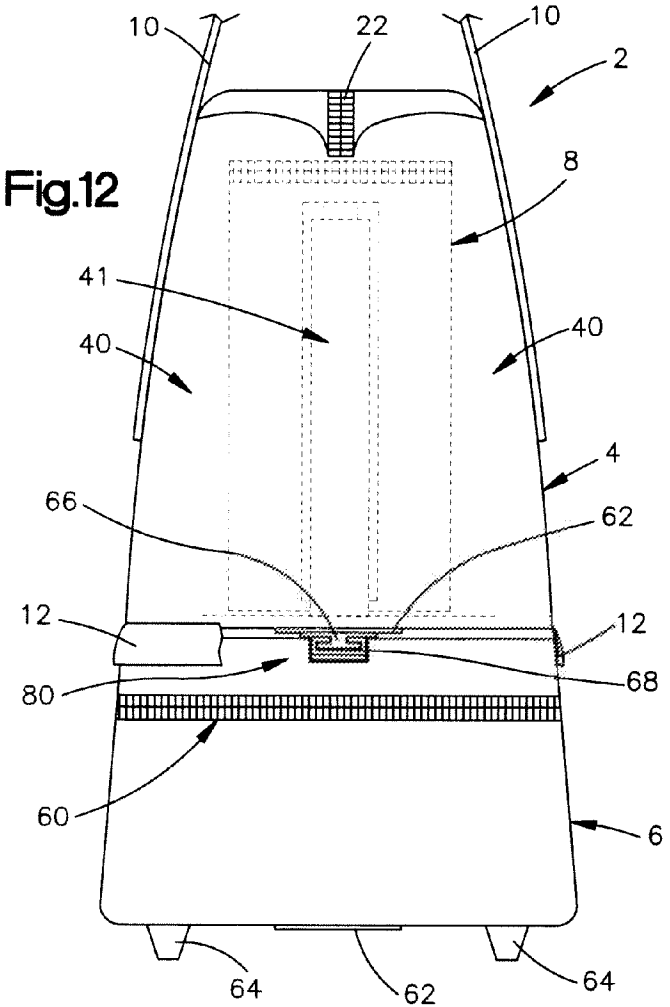
FIG. 12 is a side plan view of a carrying bag, according to one embodiment of the present invention.

Preferably, the components of the track systems are made from a substantially rigid, lightweight material such as plastic or aluminum, however, other substantially rigid materials may be used. Further, the components of the track systems may be attached to the top and bottom portions of the bag 2 by way of rivets, screws, or nuts and bolts, or the like, or the components may be sewn directly into the top 4 and bottom 6 portions. In order to allow the top portion 4 and the bottom portion 6 to fit tightly together so there is a minimal gap between the two portions of the bag 2 when they are connected to each other, low profile track components may be used or, as depicted in FIG. 12, which is a side view of the bag 2, one component of the track system may be recessed 80 into one portion of the bag 2 to which it attaches.

Figure 13:
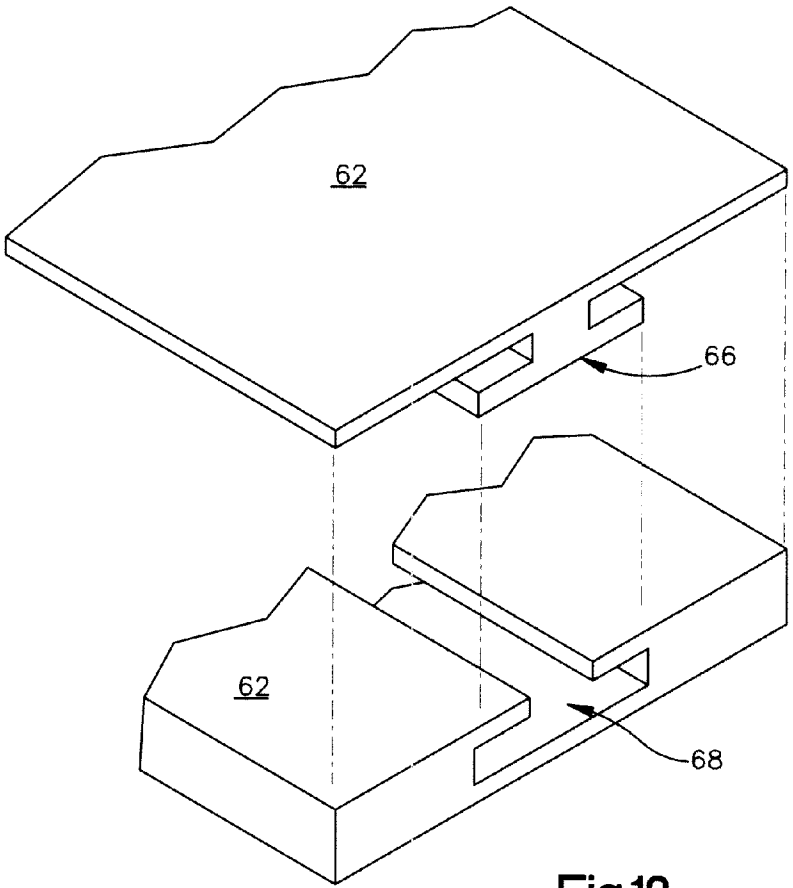
FIG. 13 is a front perspective view a track system used in a carrying bag, according to one embodiment of the present invention.

To further reinforce the components of the track systems, a reinforcing material 62 may be included on the closed bottom 18 of the top portion 4 and the closed top 50 of the bottom portion 6. Accordingly, the components of the track systems may be secured or attached to the reinforcing material 62. If a reinforcing material 62 is used or included on the exterior of the closed bottom 18 of the top portion 4 and the exterior of the closed top 50 of the bottom portion 6, instead of using separate male and female track components that attach to the top 4 and bottom 6 portions of the bag 2, the male 66 and female 68 track components may be machined directly into the reinforcing material 62 included on the top portion 4 and bottom portion 6 as depicted in FIGS. 13A and 13B.

Figure 14A:
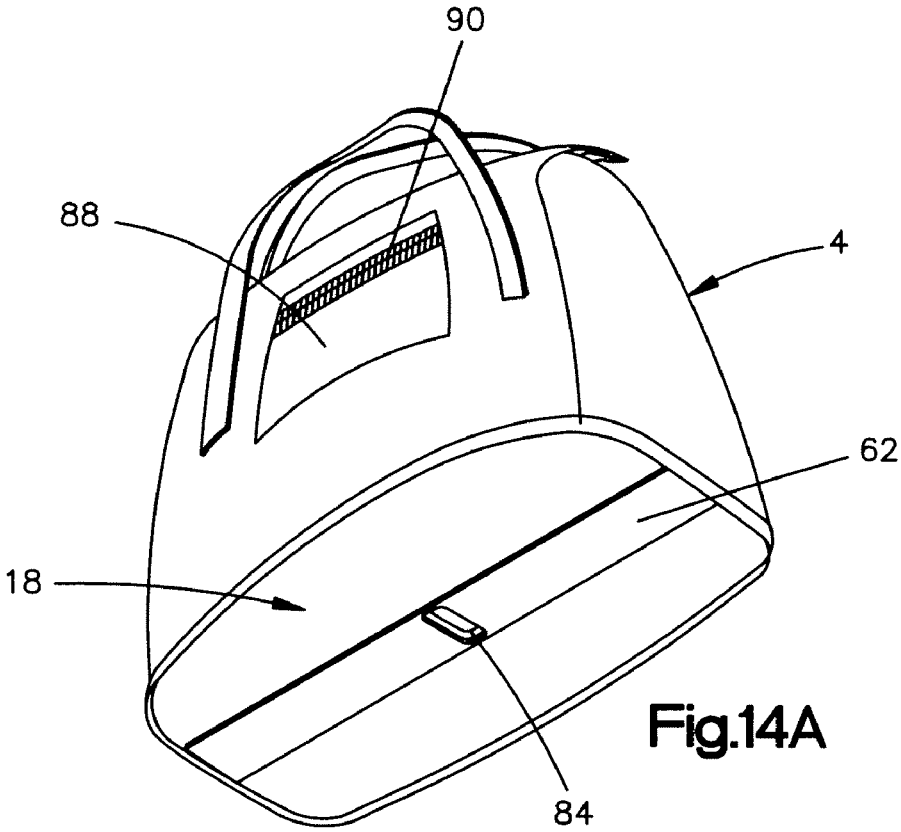
FIG. 14A is a bottom perspective view of the top portion of the carrying bag depicted in the previous figures showing a means for attaching the top portion and the bottom portion of the carrying bag to one another, according to one embodiment of the present invention.
Figure 14B:
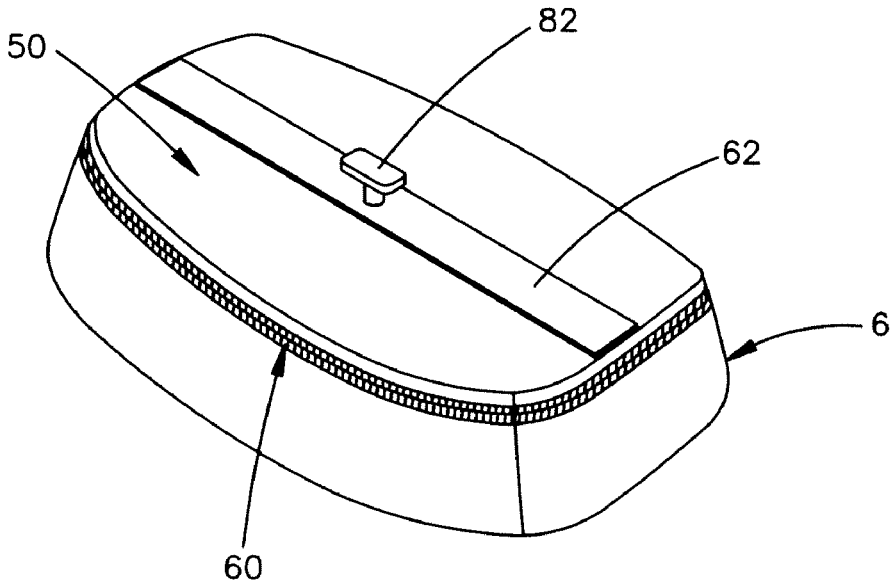
FIG. 14B is a front perspective view of the bottom portion of the carrying bag depicted in the previous figures showing a means for attaching the top portion and the bottom portion of the carrying bag to one another, according to one embodiment of the present invention.

Another embodiment of an attaching device or means that may be used to attach the top portion 4 of the bag 2 to the bottom portion 6, is depicted in FIGS. 14A and 14B. As can be seen in FIG. 14B, the bottom portion 6 includes at least one rotatable locking member 82 on the exterior surface of its closed top 50. The locking member 82 is connected to a rotation member (not shown in the figures) that is located beneath the locking member 82 in the interior compartment 54 of the bottom portion 6 such that rotation of the rotation member results in rotation of the locking member 82 in a corresponding manner. Preferably, the rotation member is located adjacent to the interior surface of the closed top 50. As can be seen in FIG. 14A, the top portion 4 includes at least one opening 84, which has a complementary shape to that of the locking member 82 and which is slightly larger than the locking member 82. The opening 84 is located on the bottom surface of the top portion's 4 closed bottom 18 in a corresponding location to the locking member 82. Preferably, the closed bottom 18 includes a rigid material such as plastic, rubber or the like, into which the opening 84 is formed. Additionally, the opening 84 preferably opens into a chamber that is separated from the interior or bucket portion of the top portion 4 so that items contained therein, do not interfere with the operation of the locking member 82.

To connect the top portion 4 and the bottom portion 6 to one another, a user brings the two portions of the bag 2 into close proximity with each other, aligns the locking member 82 with the opening 84, brings the two portions into contact with each other such that the locking member 82 is received within the opening 84, and then rotates the rotation member, which rotates the locking member 82 in a corresponding manner within the opening 84, thereby locking or joining the top portion 4 and the bottom portion 6 together. Stops may be included on the interior of the opening 84 in order to prevent over rotation of the locking member 82 and insure that the two portions remain locked or joined together. A locking device may also be included on the rotation member to prevent inadvertent rotation of the locking member 82 and hence, inadvertent separation of the top 4 and bottom 6 portions. To detach the top portion 4 from the bottom portion 6, a user releases or unlocks (if a locking device is included) the rotation member and then rotates the rotation member in a direction opposite to that used to join the portions together such that the locking member 82 re-aligns with the opening 84. Once the locking member 82 is aligned with the opening 84, a user simply removes the bottom portion from the top portion 4.

Instead of having a bottom portion 6 with a rotatable locking member 82, another embodiment of the present bag 2 may include a locking member on the bottom portion 6 that is permanently fixed at an angle 90° to the opening 84 on the bottom surface of the top portion's 4 closed bottom 18. Accordingly, instead of rotating the locking member to join the top portion 4 and the bottom portion 6 together, a user positions the top portion 4 of the bag 2 at a 90° to the bottom portion 6 such that the locking member aligns with the opening 84. The user then brings the two portions into contact with each other so that the locking member is received within the opening 84. Once the locking member is received within the opening 84, a user simply rotates one portion of the bag, typically the top portion 4, 90° clockwise or counterclockwise with respect to the other or bottom portion 6 of the bag 2, thereby rotating the locking member in a corresponding manner within the opening 84, thus joining the top portion 4 and the bottom portion 6 together.

Although an "I"-shaped locking member 82 and opening 84 are depicted in the figures, any shape locking member 82 and opening 84 may be used as long as they have complementary geometries. Further, as will be readily apparent to those skilled in the art, if rotatable locking members 82 are employed, a plurality of locking members 82 and openings 84 may be used to join or connect the top portion 4 to the bottom portion 6.

As will be readily apparent to those skilled in the art, additional attaching devices or means for attaching the top portion 4 and the bottom portion 6 of the bag 2 to each other, for example and not limited to, magnetic components, zippers, snaps, buttons, hook and loop fasteners (VELCRO®), or the like, may also be used. Accordingly, one component of the attaching device or means for attaching may be included on the top portion 4 of the bag 2 and the corresponding component of the device or means for attaching may be included on the bottom portion 6 of the bag 2.

Similar to the track attachment device previously disclosed, a reinforcing material 62 may be included on the closed bottom 18 of the top portion 4 and the closed top 50 of the bottom portion 6 to further reinforce the attaching device. Accordingly, to further support the components of the attaching device, the components may be secured or attached to the reinforcing material 62.

Figure 15:
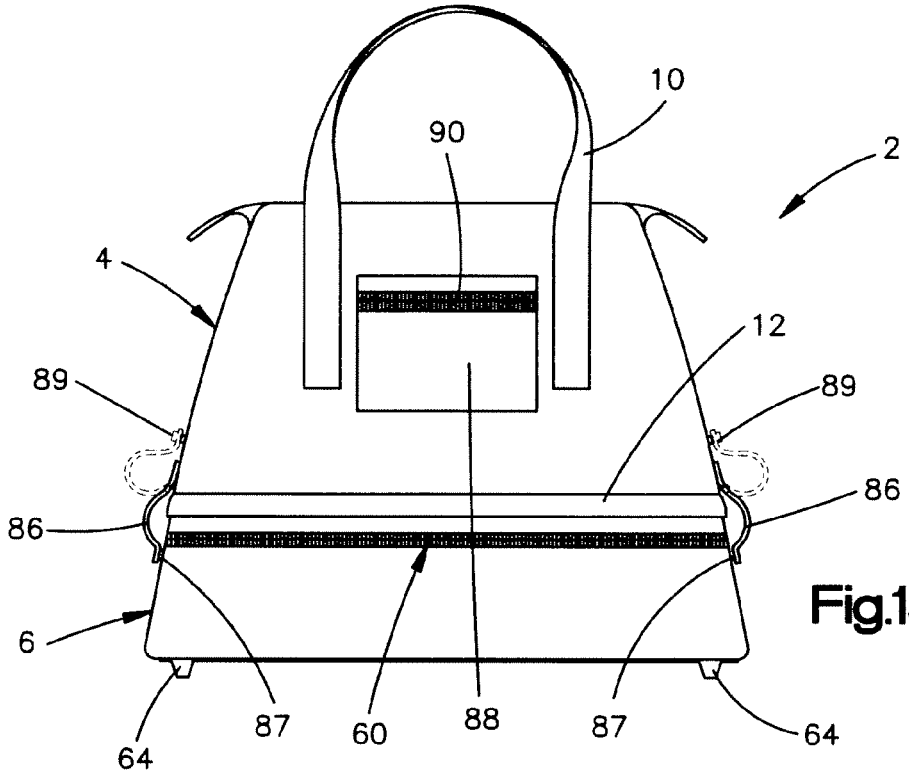
FIG. 15 is a front plan view of a carrying bag, according to one embodiment of the present invention.

As shown in FIG. 15, to further secure the top portion 4 to the bottom portion 6, additional attaching devices 86 such as snap reinforcements, may be used on the end portions 16 of the bag 2. For example, a decorative tag 86 attached to the exterior of the top portion's 4 end portions 16, can be snapped onto a snap 87 located towards the top of an exterior end of the bottom portion 6. When the bottom portion 6 is detached from the top portion 4, the tag 86 can be snapped onto a snap 89 located immediately above where the tag 86 is attached to the top potion 4, thereby creating a decorative feature on the top portion 4 of the bag 2. To help reinforce the additional attaching devices 86, the end portions of the top and bottom portions of the bag may include reinforcing material on either the inside or outside of the bag 2 where the additional attaching devices 86 attach.

As can be seen in the figures, and more specifically FIG. 1A, an apron 12 may be included on the exterior of the carrying bag 2 at the junction between the top portion 4 and bottom portion 6. The apron 12 may be formed from a material such as canvas, vinyl, plastic, rubber, or any other material and which may or may not be covered with the material used to form the exterior of the bag 2. The apron 12 has at least two functions. First, the apron 12 is used to conceal the junction between the top 4 and bottom 6 portions of the bag 2. Second, the apron 12 serves as a support for the top portion 4 when separated from the bottom portion 6 and placed, for example, on a table or floor. Accordingly, the apron 12 is capable of being flipped or rolled up to expose the junction between the top portion 4 and bottom portion 6 thereby allowing the portions to be separated from each other. Thereafter, the apron 12 is capable of being flipped or rolled back down so as to support for the top portion 4 when placed on a horizontal surface. If an apron 12 is made from a rolled material, it does not need to be flipped up and it can be used to support the top portion 4 of the bag 2 when separated from the bottom portion 6. If, however, an apron 12 is not included on the bag 2 or if it is not desired to use the apron 12 as a support for the top portion 4, as depicted in FIG. 8A, "feet" or supports may be included on the exterior surface of the top portion's 4 closed bottom 18, which can be flat against the closed bottom 18 of the top portion 4 and pulled down or extended for use such that the feet or supports are out of the way when the top and bottom portions are attached to one another.

Figure 16:
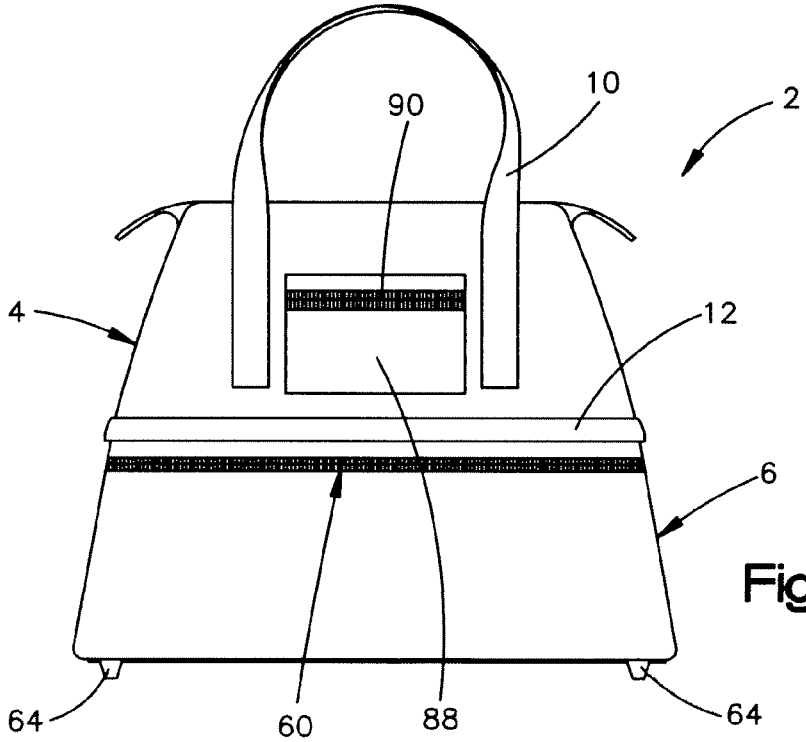
FIG. 16 is a front plan view of a carrying bag, according to one embodiment of the present invention.

As depicted in FIG. 16, because the bottom portion 6 is detachable from the top portion 4, additional embodiments of the present invention can include different size bottom portions 4 so long as the top 4 and bottom 6 portions remain proportional to one another. Also, different size bottom portions 4 may be provided and used interchangeably resulting in a carrying bag 2 having a size and carrying capacity that can be tailored or adjusted based on its intended use. For example, if traveling locally, a user may not require a carrying bag 2 with a large bottom portion 6. If, however, a user is traveling a further distance, for example, by airplane, a user will usually be carrying more items and may want or need a larger carrying capacity. Accordingly, a larger bottom portion 6 may be desired.

Figure 17A:
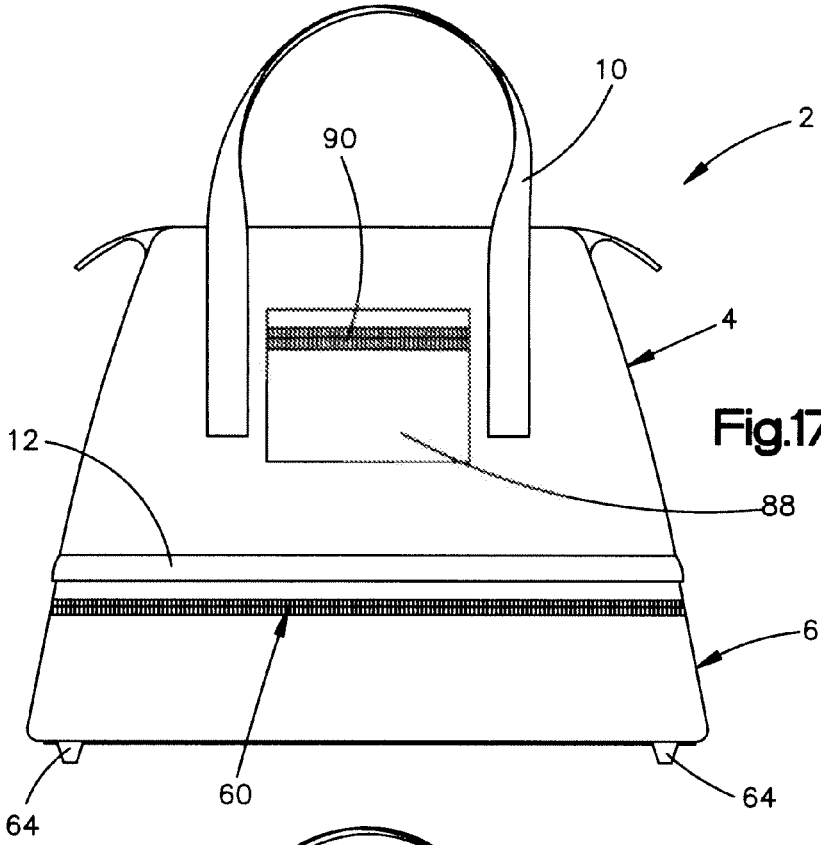
FIG. 17A is a front plan view of a carrying bag, according to one embodiment of the present invention.
Figure 17B:
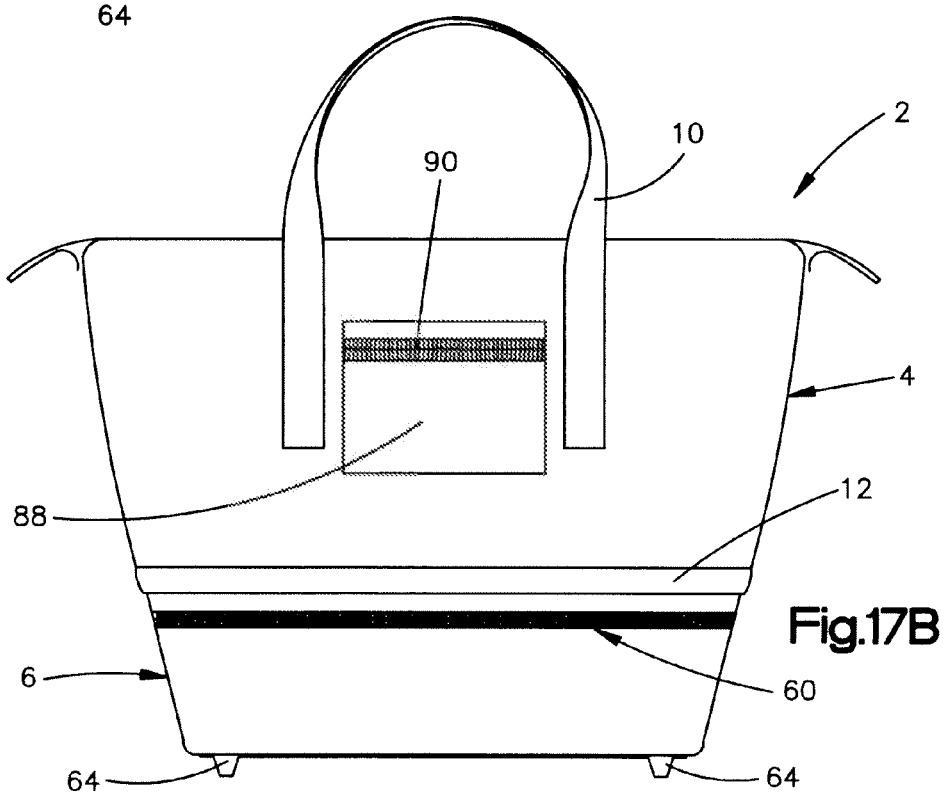
FIG. 17B is a front plan view of a carrying bag, according to one embodiment of the present invention.

Further, in additional embodiments, the carrying bag 2 of the present invention may come in various sizes such as medium, large and extra large and may be designed to have a wider bottom portion 6 (FIG. 17A) or a wider top portion 4 (FIG. 17B). Additional storage may also be included on the exterior surfaces of the top 4 and bottom 6 portions of the bag 2 through use of exterior pockets 88 of various sizes and shapes. These pockets 88 may be made from a variety of materials such as, for example, canvas, nylon, netting, mesh, plastic, etc., and may include closure devices 90 such as zippers, snaps, buttons, hook and loop fasteners (VELCRO®) or any other suitable closure device known in the art or, the pockets 88 may be made elastic, in order to prevent the items contained therein from falling. The pockets 88 may also be formed between layers of material such that a closure device, such as a zipper, may be located on the exterior surface of the bag 2, while the actual pocket space is located between the material.

Although a preferred embodiment of the present invention and modifications thereof have been described in detail herein, it is to be understood that this invention is not limited to this precise embodiment and modifications, and that other modifications and variations may be effected by one skilled in the art without departing from the spirit and scope of the invention as defined by the appended claims.

What is claimed is:

1. A carrying bag comprising:

a top portion having at least two side walls, a closable top, a closed bottom having an exterior bottom surface and an interior top compartment;

a detachable bottom portion having at least two side walls, a closed top having an exterior top surface, a closed bottom, an interior bottom compartment and at least one access opening into the interior bottom compartment;

a compartmentalized structure included in the top portion and having a plurality of individual compartments; and a track system to attach the top portion to the detachable bottom portion, wherein the track system includes a first component and a second component, wherein the first and second components slidingly engage one another, and wherein the compartmentalized structure divides the interior top compartment into distinct first and second interior areas, and wherein the first interior area of the top compartment is a first color and the second interior area of the top compartment is a second color, different than the first color.

2. The carrying bag as claimed in claim 1, wherein the first component is a track and the second component is a track.

3. The carrying bag as claimed in claim 1, wherein the first component is a female track and the second component comprises at least one post-type male element.

4. The carrying bag as claimed in claim 1, wherein the first component is attached to the exterior bottom surface of the of the top portion's closed bottom and the second component is attached to the exterior top surface of the detachable bottom portion's closed top.

5. The carrying bag as claimed in claim 1, wherein the at least one access opening in the detachable bottom portion includes a closure device.

6. The carrying bag as claimed in claim 5, wherein the closure device is selected from the group consisting of zippers, snaps, buttons and hook and loop fasteners.

7. The carrying bag as claimed in claim 1, wherein the compartmentalized structure includes at least one insulated compartment.

8. The carrying bag as claimed in claim 1, wherein the compartmentalized structure is removably attached to the carrying bag.

9. The carrying bag as claimed in claim 8, wherein the compartmentalized structure is removably attached to the carrying bag with an attaching device selected from the group consisting of a track system, snaps, buttons, zippers, hook and loop fasteners, and magnets.

10. The carrying bag as claimed in claim 1, wherein an apron is included on an exterior surface of the carrying bag at a junction between the top portion and the detachable bottom portion.

11. The carrying bag as claimed in claim 1, further comprising at least one pocket.

12. A carrying bag comprising:

a top portion having at least two side walls, a closable top, a closed bottom having an exterior bottom surface and an interior top compartment;

a detachable bottom portion having at least two side walls, a closed top having an exterior top surface, a closed bottom, an interior bottom compartment and at least one access opening into the interior bottom compartment;

a compartmentalized structure included in the top portion and having at least one compartment; and a track system, wherein the track system includes a male track and a female track, wherein either the male track or the female track is attached to the top portion and the corresponding male track or female track is attached to the detachable bottom portion, wherein the compartmentalized structure divides the interior top compartment into distinct first and second interior areas, and wherein the first interior area of the top compartment is a first color and the second interior area of the top compartment is a second color, different than the first color.

13. The carrying bag as claimed in claim 12, wherein the male or female track is attached to the exterior bottom surface of the of the top portion's closed bottom and the corresponding male or female track is attached to the exterior top surface of the detachable bottom portion's closed top.

14. The carrying bag as claimed in claim 12, wherein the male track slidingly engages the female track.

15. The carrying bag as claimed in claim 12, wherein the compartmentalized structure is removably attached to the carrying bag.

16. The carrying bag as claimed in claim 15, wherein the compartmentalized structure is removably attached to the carrying bag with an attaching device selected from the group consisting of a track system, snaps, buttons, zippers, hook and loop fasteners, and magnets.

17. The carrying bag as claimed in claim 12, further comprising at least one pocket.

18. A carrying bag comprising:

a top portion having at least two side walls, a closable top and a closed bottom having an exterior bottom surface;

a detachable bottom portion having at least two side walls, a closed top having an exterior top surface, a closed bottom and at least one access opening;

a compartmentalized structure included in the top portion and having at least one compartment; and a means for attaching the top portion to the detachable bottom portion, wherein the means for attaching the top portion to the detachable bottom portion includes a first component and a second component, wherein the first component is included on the top portion and the second component is included on the detachable bottom portion, wherein the compartmentalized structure divides the interior top compartment into distinct first and second interior areas, and wherein the first interior area of the top compartment is a first color and the second interior area of the top compartment is a second color, different than the first color.

19. The carrying bag as claimed in claim 18, wherein the compartmentalized structure is removably attached to the carrying bag.

20. The carrying bag as claimed in claim 18, wherein the compartmentalized structure comprises a plurality of compartments.

21. The carrying bag as claimed in claim 18, wherein the carrying bag further comprises a means for attaching the compartmentalized structure to the carrying bag.

22. A carrying bag comprising:

a top portion having at least two side walls, two end portions, a closable top, a closed bottom having an exterior bottom surface and an interior top compartment having a plurality of pockets;

a detachable bottom portion having at least two side walls, a closed top having an exterior top surface, a closed bottom, an interior bottom compartment and at least one access opening having a zipper;

a compartmentalized structure having a plurality of individual compartments and two end portions, the compartmentalized structure being removably attached to the interior top compartment with a first track system, the first track system comprising at least one first component attached to each end portion of the compartmentalized structure and at least one second component attached to each end portion of the top portion;

at least one carrying strap;

at least one pocket; and a second track system to attach the top potion to the detachable bottom portion, wherein the second track system includes a male component attached to either the exterior bottom surface of the of the top portion's closed bottom or the exterior top surface of the detachable bottom portion's closed top and a female component attached to either the exterior bottom surface of the of the top portion's closed bottom or the exterior top surface of the detachable bottom portion's closed top, wherein the compartmentalized structure divides the interior top compartment into distinct first and second interior areas, wherein the first interior area of the top compartment is a first color and the second interior area of the top compartment is a second color that is different from the first color, wherein an apron is included on an exterior surface of the carrying bag at a junction between the top portion and the detachable bottom portion, and wherein at least one of the individual compartments in the compartmentalized structure is insulated.

* * * * *